US009856667B2

(12) United States Patent
Cox

(10) Patent No.: US 9,856,667 B2
(45) Date of Patent: Jan. 2, 2018

(54) LOW GRAVITY FED WATER SYSTEM WITHOUT SUBMERSED DRAINS WITHIN THE BATHING CHAMBER FOR POOLS AND SPAS

(76) Inventor: Wesley O. Cox, Johnstown, NY (US)

( * ) Notice: Subject to any disclaimer, the term of this patent is extended or adjusted under 35 U.S.C. 154(b) by 264 days.

(21) Appl. No.: 14/122,467

(22) PCT Filed: May 25, 2012

(86) PCT No.: PCT/US2012/039582

§ 371 (c)(1),
(2), (4) Date: Feb. 26, 2014

(87) PCT Pub. No.: WO2012/166597

PCT Pub. Date: Dec. 6, 2012

(65) Prior Publication Data

US 2014/0157507 A1 Jun. 12, 2014

Related U.S. Application Data

(60) Provisional application No. 61/491,015, filed on May 27, 2011, provisional application No. 61/503,165,
(Continued)

(51) Int. Cl.
*E04H 4/00* (2006.01)
*E04H 4/12* (2006.01)
*A61H 33/00* (2006.01)

(52) U.S. Cl.
CPC ..... *E04H 4/1245* (2013.01); *A61H 33/0087* (2013.01); *A61H 33/6005* (2013.01);
(Continued)

(58) Field of Classification Search
CPC ..... E04H 4/1245; A61H 33/0087; A61H 33/6005
(Continued)

(56) References Cited

U.S. PATENT DOCUMENTS 2,936,891 A 5/1960 Kukowski et al.
3,918,107 A 11/1975 Whitten, Jr. et al.
(Continued)

FOREIGN PATENT DOCUMENTS

JP 06-064593 9/1994
JP 07-308531 11/1995
(Continued)

OTHER PUBLICATIONS

Gregory Korte and Melanie Eversley, "Recall of Pool Drain Covers Could Dampen Summer Start", USA Today, printout available on Nov. 18, 2013, at http://usatoday30.usatoday.com/NEWS/usaedition/2011-05-27-Pool-investigation_ST_U.htm?sms_email&at_xt=4ddff980f06a8039%2C0, 2-pages, May 26, 2011.
(Continued)

*Primary Examiner* — Christine Skubinna
(74) *Attorney, Agent, or Firm* — Heslin Rothenberg Farley & Mesiti P.C.

(57) ABSTRACT

A low gravity fed water system includes a housing having an inlet opening, a portion of the inlet opening disposed above the waterline and a portion of the inlet opening disposed below the waterline. The housing has an outlet opening disposed in the housing below the waterline in fluid communication with the plurality of jets. The housing has a vent opening disposed in the housing below the waterline. An upwardly-extending conduit is connectable at a first end to the vent opening, and has a second end disposed above the waterline in ambient air away from an inside surface of the housing and away from an inside surface of the tub. In the event of a blockage of the inlet opening, air is drawn into the housing via the conduit inhibiting a suction being drawn on the inlet opening.

40 Claims, 24 Drawing Sheets

Related U.S. Application Data filed on Jun. 30, 2011, provisional application No. 61/526,945, filed on Aug. 24, 2011.

(52) U.S. Cl.
CPC .. *A61H 33/6021* (2013.01); *A61H 2033/0037* (2013.01); *A61H 2201/0173* (2013.01)

(58) Field of Classification Search
USPC ..... 4/492, 488–497, 507–509; 210/167.1, 210/167.12, 167.13
See application file for complete search history.

(56) References Cited

U.S. PATENT DOCUMENTS

| | | | | |
|---|---|---|---|---|
| 4,349,434 | A | 9/1982 | Jaworski | |
| 4,533,476 | A * | 8/1985 | Watkins | A61H 33/0087 210/167.12 |
| 4,706,309 | A | 11/1987 | van den Broek | |
| 5,347,664 | A | 9/1994 | Hamza et al. | |
| 5,499,406 | A | 3/1996 | Chalberg et al. | |
| 6,038,712 | A | 3/2000 | Chalberg et al. | |
| 6,088,842 | A | 7/2000 | Barnett | |
| 6,341,387 | B1 | 1/2002 | Zars | |
| 6,395,167 | B1 | 5/2002 | Mattson, Jr. et al. | |
| 6,572,765 | B2 | 6/2003 | Lincke | |
| 6,591,863 | B2 | 7/2003 | Ruschell et al. | |
| 6,643,859 | B1 | 11/2003 | Brennan et al. | |
| 6,754,916 | B1 | 6/2004 | Cox | |
| 6,760,931 | B1 | 7/2004 | Mattson, Jr. et al. | |
| 7,040,060 | B2 | 5/2006 | Cox | |
| 7,082,625 | B2 | 8/2006 | Cox | |
| 7,296,308 | B2 * | 11/2007 | Turner | E04H 4/1209 239/390 |
| 7,300,576 | B1 * | 11/2007 | Blake | E04H 4/1272 210/167.1 |
| 7,306,718 | B2 | 12/2007 | Gardenier | |
| 7,346,938 | B2 | 3/2008 | Mattson, Jr. et al. | |
| D596,266 | S | 7/2009 | Tatum | |
| 7,820,041 | B2 | 10/2010 | Hilton et al. | |
| 7,931,447 | B2 | 4/2011 | Levin et al. | |
| 8,011,032 | B2 | 9/2011 | Cline et al. | |
| 2008/0029164 | A1 | 2/2008 | Ciochetti | |
| 2012/0145251 | A1 * | 6/2012 | Robol | E04H 4/1245 137/14 |

FOREIGN PATENT DOCUMENTS

| | | |
|---|---|---|
| WO | WO 99-18307 | 4/1999 |
| WO | WO 2012/166597 | 12/2012 |

OTHER PUBLICATIONS

Weirs—Flow Rate Measure, Engineering ToolBox, printout available on May 27, 2011, at http://www.engineeringtoolbox.com/weirs-flow-rate-d_592.html, 7-pages, at least as early as Aug. 14, 2010.

Dyna-Flo Top-Mount Skim Filters, available from Waterway Plastics, Oxnard, California, printout available on Nov. 18, 2013, at http://www.waterwayplastics.com/catalogs/2011_spaoem_11_skimfilters.pdf, 4-pages, Nov. 23, 2010.

Drains & Suctions—Ratings You Can Trust / 5"Ultra Flo Suctions for Portable Spas, available from Waterway Plastics, Oxnard California, printout available on Nov. 18, 2013, at http://www.waterwayplastics.com/catalogs/2011_spaoem_07_dranssuctions.pdf, 4-pages, Nov. 23, 2010.

Replacement Parts / 50 sq. ft. Skim Filter, available from Waterway Plastics, Oxnard, California, printout available on Nov. 18, 2013, at http://www.waterwayplastics.com/catalogs/2011_spaoem_18_repparts.pdf, 4-pages, Nov. 23, 2010.

Search Report and Search Opinion for PCT/US2012/039582, published as WO2012/166597, 11-pages, dated Jan. 31, 2013.

International Preliminary Report on Patentability for PCT/US2012/039582, published as WO2012/166597, 7-pages, dated Dec. 2, 2013.

* cited by examiner

LOW GRAVITY FED WATER SYSTEM WITHOUT SUBMERSED DRAINS WITHIN THE BATHING CHAMBER FOR POOLS AND SPAS

CROSS-REFERENCE TO RELATED APPLICATIONS

This application is a 371 national stage filing of PCT International Application No. PCT/US2012/039582 filed on May 25, 2012, and published in English on Dec. 6, 2012, as WO/2012/166597, which claims the benefit of U.S. Provisional Patent Application Ser. No. 61/491,015, filed May 27, 2011, entitled "Low Gravity Fed Water System Without Submersed Drains Within The Bathing Chamber For Pools And Spas", U.S. Provisional Patent Application Ser. No. 61/503,165, filed Jun. 30, 2011, entitled "Low Gravity Fed Water System Without Submersed Drains Within The Bathing Chamber For Pools And Spas", and U.S. Provisional Patent Application Ser. No. 61/526,945, filed Aug. 24, 2011, entitled "Low Gravity Fed Water System Without Submersed Drains Within The Bathing Chamber For Pools And Spas", the subject matter of these applications being incorporated in their entirety herein by reference.

FIELD OF THE INVENTION

This invention relates generally to pools and spas, and more specifically, to low gravity fed water system for pools, spas, and the like, for reducing the likelihood of entrapment of a person's hair, body, or bathing suit.

BACKGROUND OF THE INVENTION

Spas such as hot tubs have enjoyed increased popularity in recent years. Spas typically provide a means for bathers to relax in a controlled environment of warmth and gentle water massage.

FIG. 1 illustrates a conventional spa 10. A tub 12 is generally formed of rigid material and permanently mounted or fixed either in the ground or above the ground at a specific location. For circulating the water, a water pumping system 14 is provided which includes a pump 15 pulling water from the bathing chamber through submersed suctions or drains 16, and returning the water back to the bathing chamber by way of therapeutic pressure jets 18. This process is known in the industry as "hydrotherapy." The jets typically push water out at a pressure of 8 to 15 psi per jet. The pumps typically range from 100 gallons per minute to 300 gallons per minute but can be as much as 450 gallons per minute per pump. Spas typically include one or more pumps depending on the size of the spa and the number of jets in the spa.

There have been numerous cases of serious injuries and deaths caused by high vacuum levels at a pool or spa's drain which holds an individual to the drain. Various attempts have been made for preventing injury to persons due to the high vacuum levels at the pool's drain in pools and spas.

For example, U.S. Pat. No. 7,820,041 issued to Hilton et al. discloses a drain cover designed for swimming pools, spas, whirlpools and the like that is non-flat and clover-shaped containing three or more "leaves" that provides for strengthened rigidity, and increased protection against hair and body entrapment.

U.S. Pat. No. 7,931,447 issued to Levin et al. discloses a drain safety and pump control device for pools and spas. The device includes a vacuum sensor for sensing a level of vacuum present in the suction conduit leading to the pumps.

The vacuum level is monitored by a computer that controls a vent valve that can vent to atmosphere to reduce the vacuum exerted at a drain disposed at the bottom of the pool or spa.

U.S. Pat. No. 6,591,863 issued to Ruschell et al. discloses an adjustable pool safety valve for swimming pools that senses and then instantly relieves excessively high vacuum levels in the pool's drain line, such as when an individual becomes trapped by the suction at the pool's drain port which is connected to the drain line. The valve includes a spring biased mechanism which is tripped to relieve the high vacuum level in the pool's drain line and the suction at the drain port by bleeding air into the pool's drain line, causing the pump connected to the drain line to lose prime.

Swimming pools typically employ a skimmer in the upper part of the side of the pool that catches floating debris before it gets saturated and sinks to the bottom. A skimmer typically includes a basket, a lid, and a weir or floating door. A pipe attached to the bottom of the skimmer connects to the pool's filter pump. Water is pulled through the skimmer by the pump. The weir floats at the water level, causing the suction to speed up and pull in more of the debris. The debris gets stuck in the basket as the water goes into the filter and is cycled back into the pool. The typical flow rate though a skimmer is about 50 gallons per minute to about 75 gallons per minute. When the pump is shut off, the weir closes off the skimmer and keeps debris from coming out of the basket and back into the pool.

U.S. Pat. No. 7,300,576 issued to Blake discloses a swimming pool cleaning system having a pump, a first tube coupling a suction port of the pump in fluid communication with a main drain or mobile cleaning device which draws water and settled debris from the bottom of the pool, and a skimming device having a cylindrical body, an entrainment nozzle and a safety tube. The entrainment nozzle is coupled by a second tube to a coupling device which diverts a small portion of pool return water pumped from an outlet port of the pump. The safety tube connects the inside of the body of the skimmer above the waterline and above the debris trap to the inside of the body of the skimmer below the waterline the debris trap. Most of the pool return water is pumped into a rotary distribution valve, various outlets of which are connected to various pool cleaning heads embedded in an inner surface of the pool. A single low-horsepower pump produces simultaneous effective skimming and operation of embedded cleaning heads.

There is a need for further pools and spas, and more specifically, to low gravity fed water system for pools, spas, and the like, for reducing the likelihood of entrapment of a person's hair and body.

SUMMARY OF THE INVENTION

In a first aspect, the present invention provides a spa or pool comprising a tub having a plurality of jets disposed in the tub for discharging water into a bathing chamber of the tub. The tub has no completely submersed openings in the bathing chamber for receiving water dischargeable from the plurality of jets. A low gravity fed water system receives water from the tub. The low gravity fed water system includes a housing having an inlet opening for receiving water from the tub at a waterline. A portion of the inlet opening is disposed above the waterline and a portion of the inlet opening is disposed below the waterline. The housing has at least one outlet opening disposed in the housing below the waterline operably connectable in fluid communication to the plurality of jets. The housing has at least one vent opening disposed in the housing below the waterline. An upwardly-extending conduct is connectable at a first end to the vent opening, and has a second end disposed above the waterline in ambient air away from an inside surface of the housing and away from an inside surface of the tub. At least one pump is operably connected to the outlet opening of the housing for receiving water from the housing and discharging water from the plurality of jets. In the event of a blockage of the inlet opening air is drawn into the housing via the conduit inhibiting a suction being drawn on the inlet opening.

In a second aspect, the present invention provides a method for circulating water in a pool or spa having no completely submersed openings in the bathing chamber of the pool or spa for receiving water during operation of pumping water to a plurality of jets in the bathing area. The method includes receiving water in a housing having an inlet opening disposed along an inside surface of the tub. A portion of the inlet opening is disposed above the waterline and a portion of the inlet opening is disposed below the waterline. Water, received from at least one outlet opening in the housing disposed below the waterline, is pumped to a plurality of jets for discharge back into the bathing chamber in the tub. Air is received, via a vent opening in the housing below the inlet opening and the waterline, in the event of a blockage of the inlet opening causing air to be drawn into the housing via the conduit inhibiting a suction being drawn on the inlet opening. The vent opening is connected to a conduit at a first end and having a second end disposed away from the inside surface of the tub and away from the inside of the housing above the waterline in ambient air.

In a third aspect, the present invention provides a vertical bar grating system for use in a spa or pool, in a low gravity fed water system that reduces the likelihood of entrapment or entanglement. The system includes a plurality of vertically disposed spaced-apart members defining a plurality of openings for receiving water from the spa or pool into the low gravity fed water system and wherein the plurality of openings extend substantially the entire length of the members.

In a fourth aspect, the present invention provides a filter system for use in filtering fluid in a pool or spa. A filter system includes a filter housing, and a filter device disposed in the housing. The filter device has a filter defining a passageway for transporting filtered fluid therethrough. The filter is operably connectable to said filter device and has an opening fluidly connectable to said passageway, and comprises a plurality of openings for receiving unfiltered fluid in said housing. A check valve disposed in said filter mount having a first position operable for allowing filtered water to pass through said filter system to a pump and inhibit passage of unfiltered water through said filter system to the pump, and a second position operable for allowing filtered water to pass through said filter system to the pump and passage of unfiltered water through said filter system to the pump.

BRIEF DESCRIPTION OF THE DRAWINGS

The subject matter which is regarded as the invention is particularly pointed out and distinctly claimed in the concluding portion of the specification. The invention, however, may best be understood by reference to the following detailed description of various embodiments and the accompanying drawings in which:

DETAILED DESCRIPTION OF THE INVENTION

Some of the aspects of the present invention are directed to systems and methods for reducing the likelihood of a person being trapped and/or injured by the suction exerted on them by water flowing into a drain, and in particular to fluid circulation systems in pools, spas, and the like, including hot tubs, swim spas, etc.

The present invention, in one aspect, the suction or drains disposed in the bathing area of the spa or hot tub are removed and replaced with a low gravity fed water system, which may be located generally safely outside the bathing area or chamber.

Figure 1:
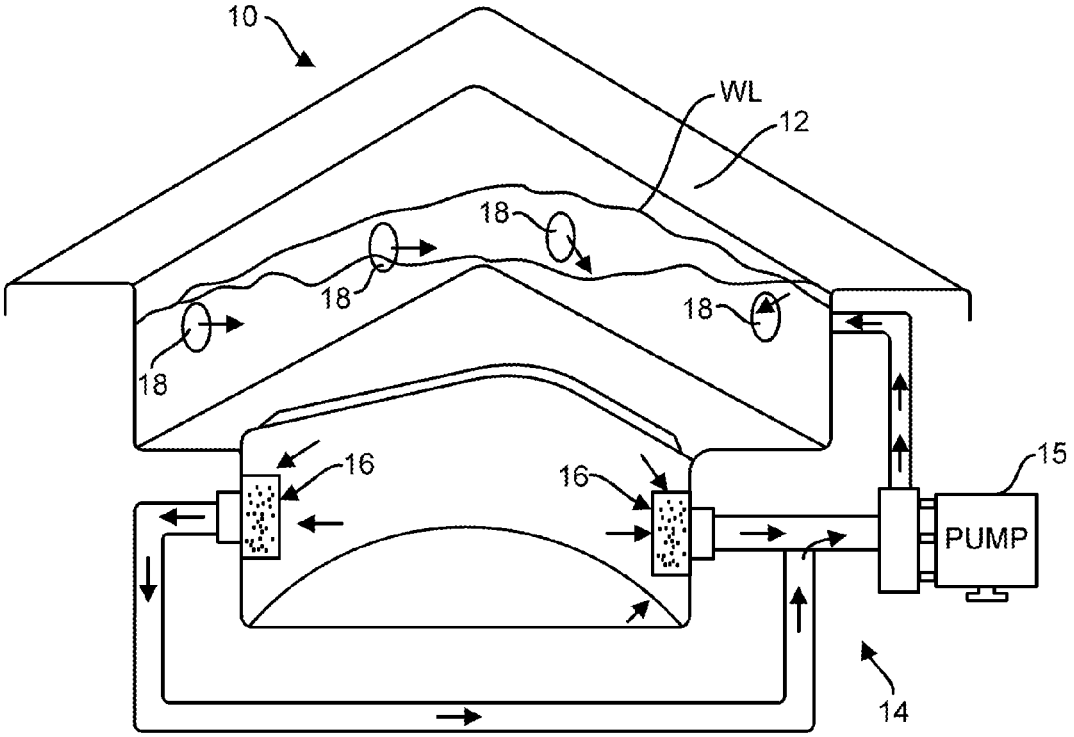
PRIOR ART FIG. 1
FIG. 1 is a diagrammatic, partial perspective view, in part cross-section, of a conventional spa having suctions or drains disposed in the bathing chamber of the spa.
Figure 2:
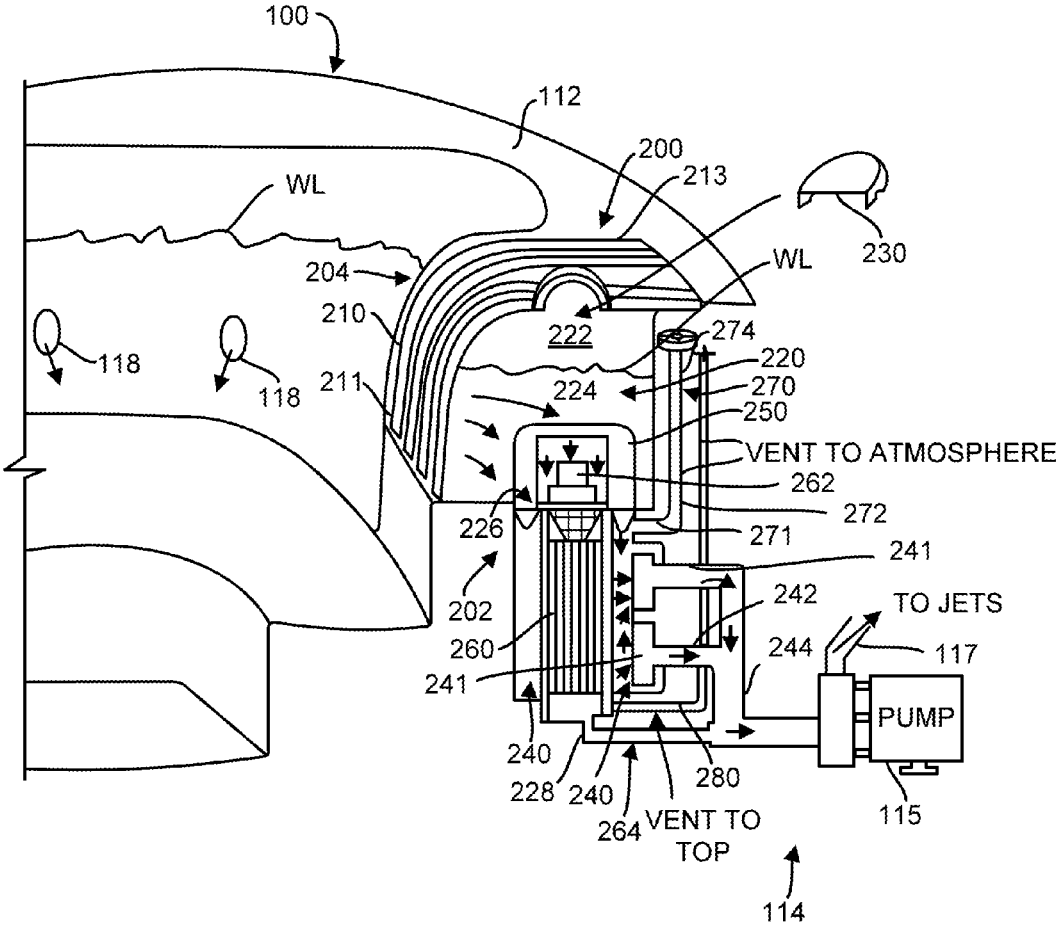
FIG. 2 is a diagrammatic, partial perspective view, in part cross-section, of one embodiment of a low gravity fed water system for spas in accordance with aspects of the present invention.

FIG. 2 illustrates one embodiment of a spa 100 in accordance with aspects of the present invention. Spa 100 includes a tub 112 which may be generally formed from a generally rigid material and permanently mounted or fixed either in the ground or above the ground at a specific location. A water pumping system 114 is provided which includes a pump 115.

In this illustrated embodiment, instead of drains or suctions disposed in the bathing area or below the surface of the water, water pumping system 114 includes pump 115 pulling water from the spa through a low gravity fed water system 200, and returning the water back to the bathing chamber by way of therapeutic pressure jets 118.

Low gravity fed water system 200 includes a housing 202 having an inlet opening 204 which may include or be covered by, for example, a grill 210 such as a vertical bar grill defining an upper chamber 220 having an upper portion 222 that extends above a waterline WL in the spa, and a lower portion 224 which is disposed below the waterline in the spa. In one aspect, the grill allows clothing or hair to safely and freely slide up and above the water level without restriction, therefore, reducing the likelihood of clothing, body, and/or hair becoming entrapped or entangled below the water level. A vented service cover 230 may also be provided for accessing chamber 220. The features of the vented grill aid in reducing the likelihood for pump 115 to create a vacuum in the bathing area as well as in upper chamber 220.

Figure 3:
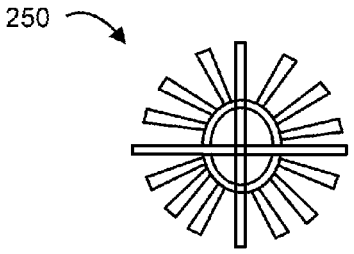
FIG. 3 is a top view of the grill for covering the lower chamber in the low gravity fed system of FIG. 2.

In addition, water is gravity fed from lower portion 224 of upper chamber 220 to a lower chamber 240 via an intermediate opening or inlet 226 such as an annular opening extending around a cylindrical filter assembly 260. The top of the filter assembly 260 and annular intermediate opening 226 may be covered by a grill or grating 250 (best shown in FIG. 3). With reference again to grill 210, grill 210 may comprise vertically disposed spaced-apart members 211 such as slats or bars defining a plurality of opening for receiving water from the spa or pool. The falling water though the passageways between the bars results in grill 250 reducing the likelihood of the possibility of water creating a vortex. Grill 250 also reduces the likelihood of access to the lower water chamber 240.

Water gravity fed into lower chamber 240 may be carried out one or more outlet openings such as via conduits 242 and 244 to pump 115. Water may also be gravity fed into filter assembly 260 via an opening or inlet 262. Water filtered in filter assembly 260 is carried via a conduit 264 to pump 115. Water pumped by pump 115 is returned to the bathing chamber via conduit 117 to jets 118. In another embodiment a grill may extend over and form a case over inlet 262 of filter 260 and horizontal bars or grill may extend over annular intermediate opening 226.

In one aspect of the present invention, in the event that grill 210 or grill 250 becomes clogged or blocked, the vacuum in lower chamber 240 will be emptied by a vacuum release 270 such as a conduit which vents lower chamber 240 to the atmosphere above waterline WL. For example, a lower end 272 of conduit 270 may operably connect to a vent opening 271 in housing 202. A second end 274 may be disposed above the waterline in ambient air (e.g., atmosphere) away from an inside surface of the housing and away from an inside surface of the tub. A second vacuum release 280 may be provided which vents the lower portion of filter 260 in the event opening or inlet 262 becomes blocked. For example, if only inlet 262 is clogged or blocked, the vacuum in filter 260 will be emptied by vacuum release 280 such as a conduit which vents filter 260 to the atmosphere above a water line WL. Release vent 270 may be effective to vent both lower chamber 240 and filter 260. The vents may be freely open to the atmospheric air at their upper ends and throughout the vent, i.e., not having a valve or other mechanism that moves or otherwise operates to open the vent upon blockage of the low gravity fed water system.

Figure 4:
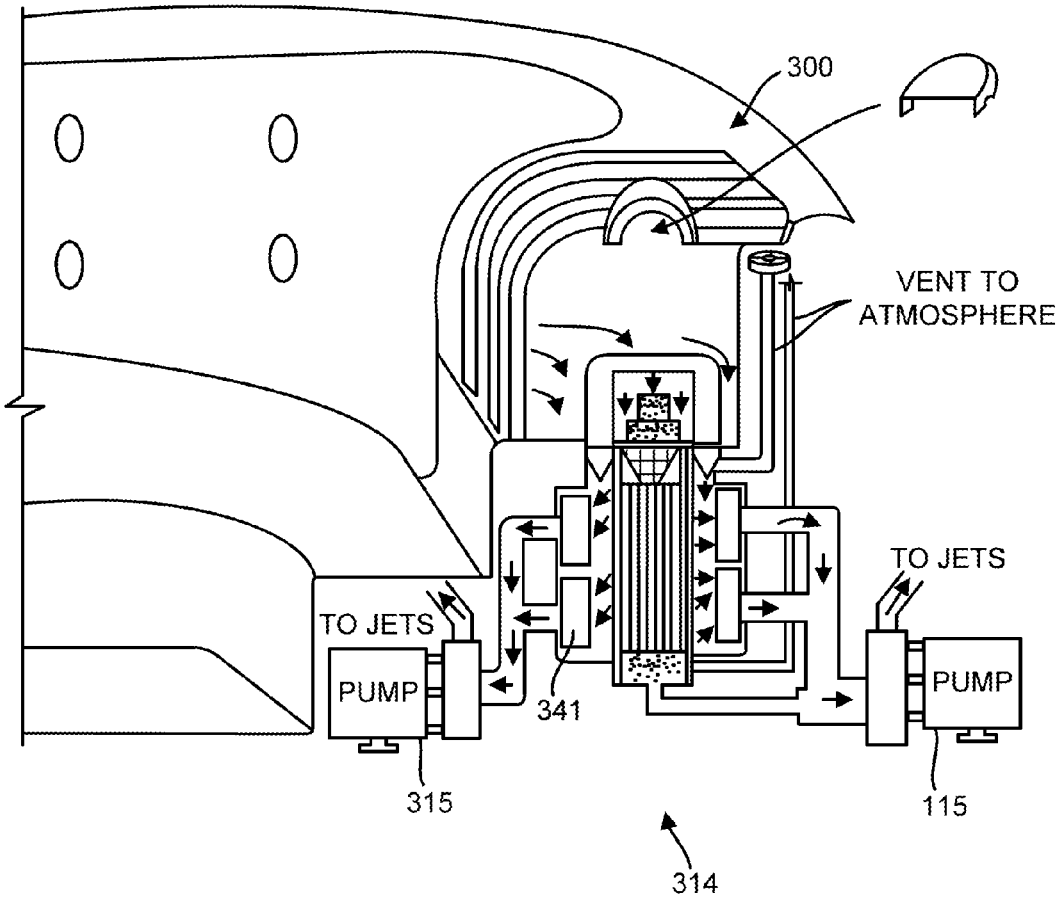
FIG. 4 is a diagrammatic, partial perspective view, in part cross-section, of another embodiment of a low gravity fed water system for spas employing two pumps in accordance with aspects of the present invention.

FIG. 4 illustrates another embodiment of a water pumping system 314 having two pumps. For example, a pump 115 and a pump 315 may be employed to pull water from the bathing chamber through a low gravity fed water system 300.

Figure 5:
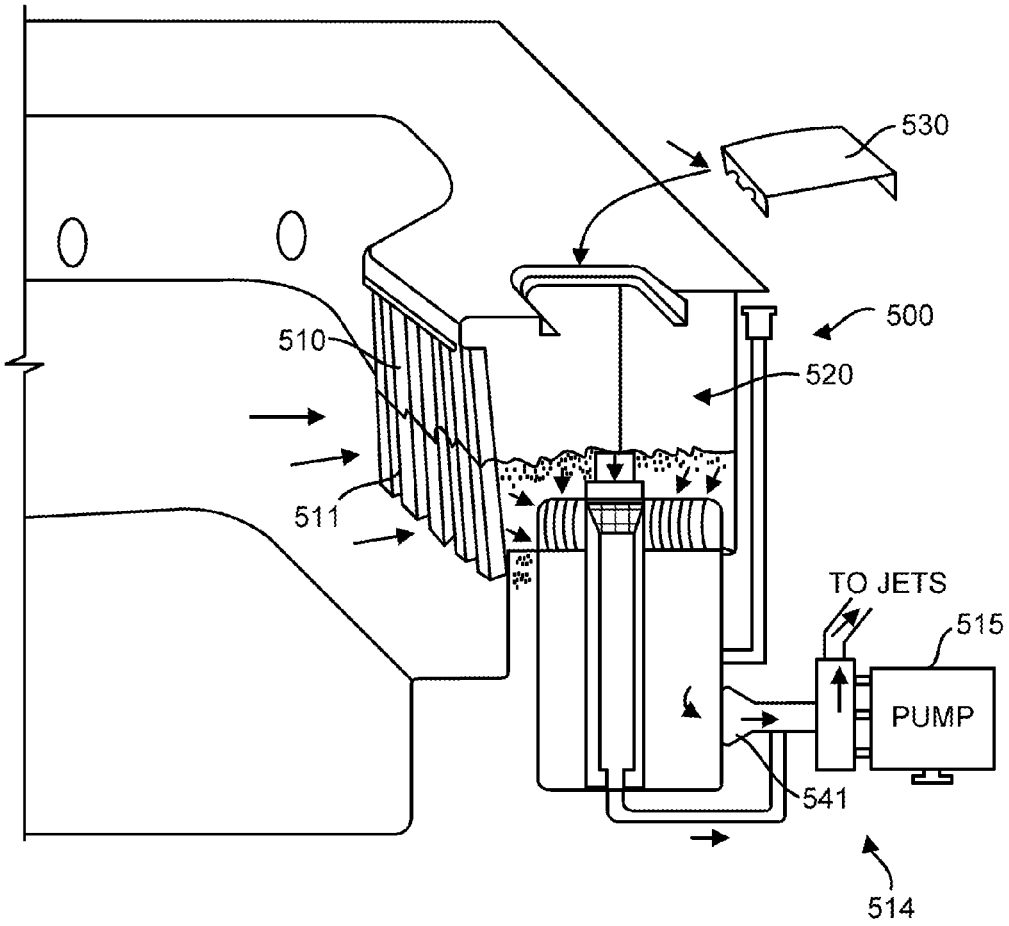
FIG. 5 is a diagrammatic, partial perspective view, in part cross-section, of another embodiment of a low gravity fed water system for spas in accordance with aspects of the present invention.
Figure 6:
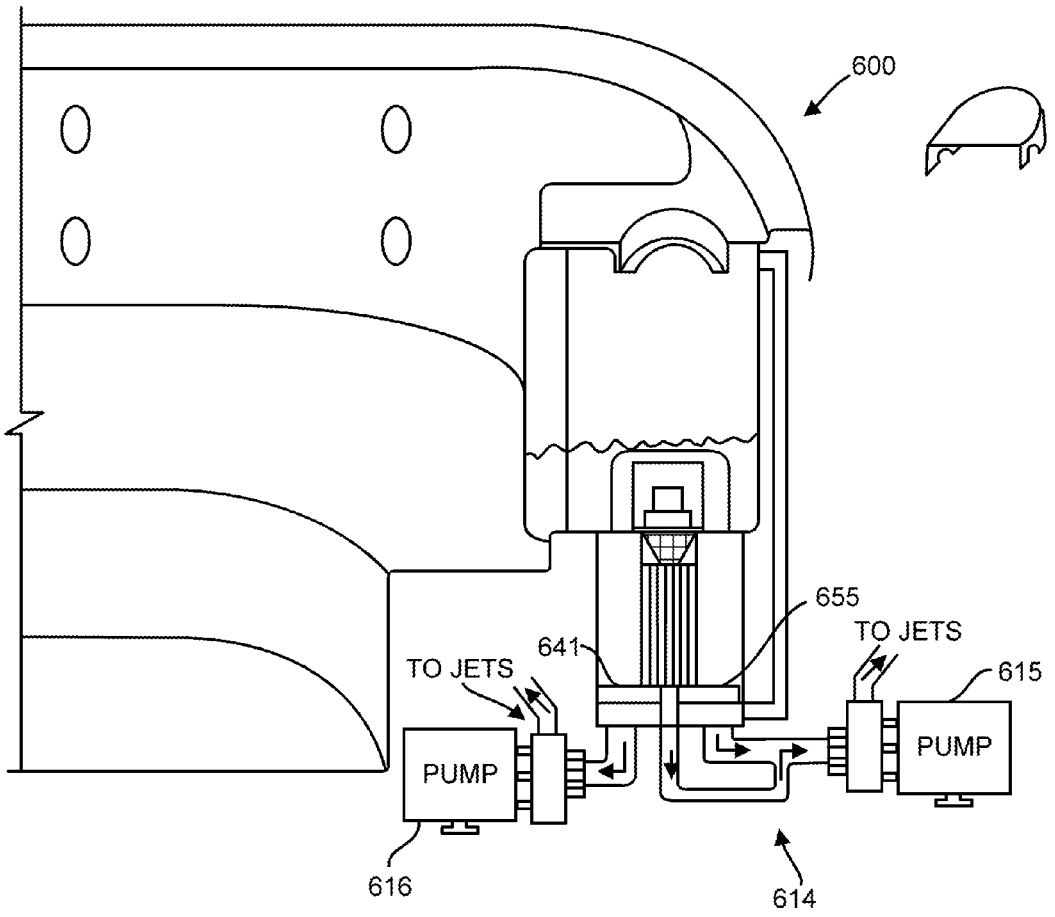
FIG. 6 is a diagrammatic, partial perspective view, in part cross-section, of another embodiment of a low gravity fed water system for spas in accordance with aspects of the present invention.

FIG. 5 illustrates another embodiment of a water pumping system 514 which includes a pump 515 pulling water from the bathing chamber through a low gravity fed water system 500. An upper chamber 520 may be covered with a solid cover along the top and a service cover 530 may be provided for accessing upper chamber 520. A grill 510 may extend vertically to define an inlet opening FIG. 6 illustrates another embodiment a water pumping system 614 which includes a pump 615 and a pump 616 pulling water from the bathing chamber through the bottom of a lower chamber of a low gravity fed water system 600. A cover of grill 655 may extend along the bottom and over the outlet openings of the housing which is fluidly connected to the pumps.

Figure 7:
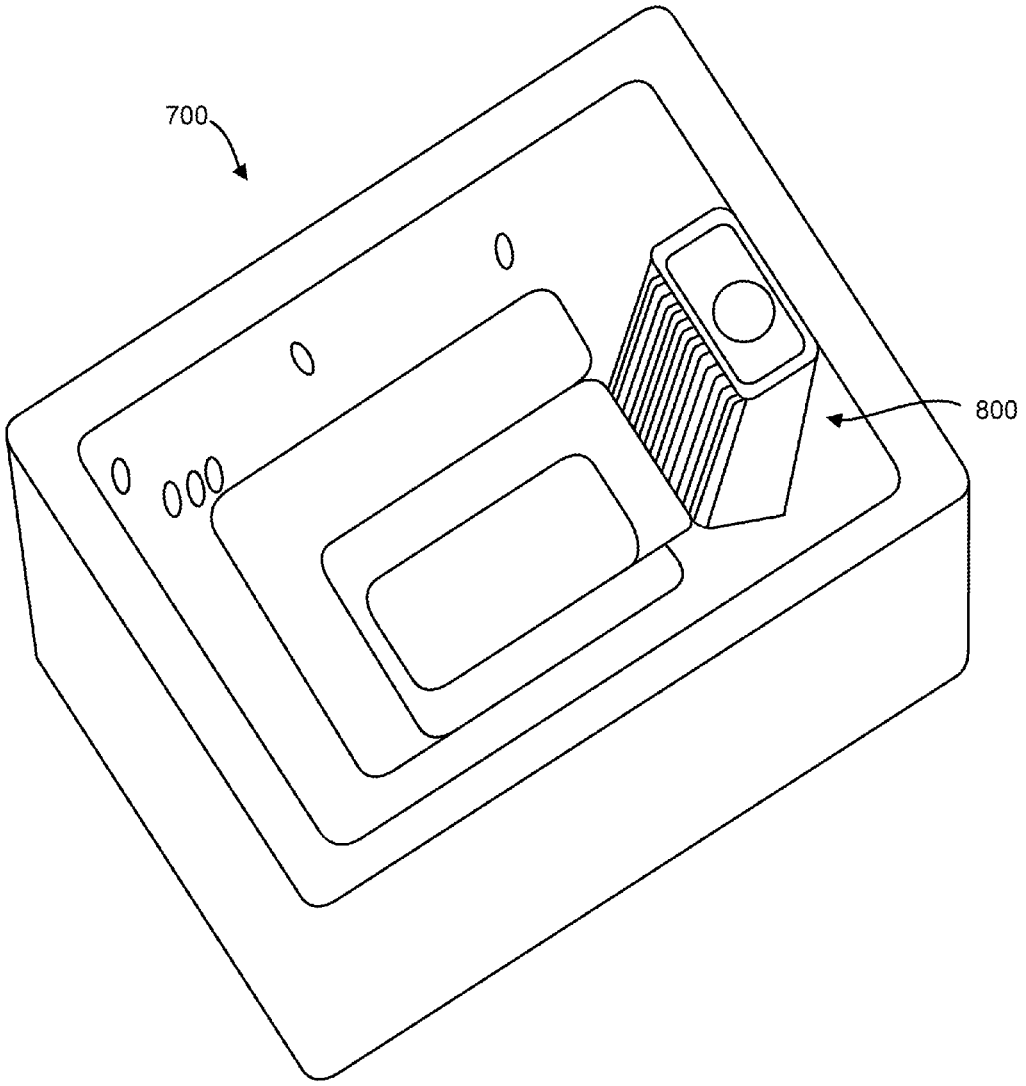
FIG. 7 is a perspective view of another embodiment of a spa incorporating a low gravity fed water system in accordance with aspects of the present invention.

FIG. 7 illustrates another embodiment a spa 700 having a low gravity fed water system 800. The low gravity fed water system may be positioned in the spa so that people in the spa are generally prohibited from sitting directly in front of the low gravity fed water system, e.g., the seating portion being disposed away from the low gravity fed water system.

Figure 8:
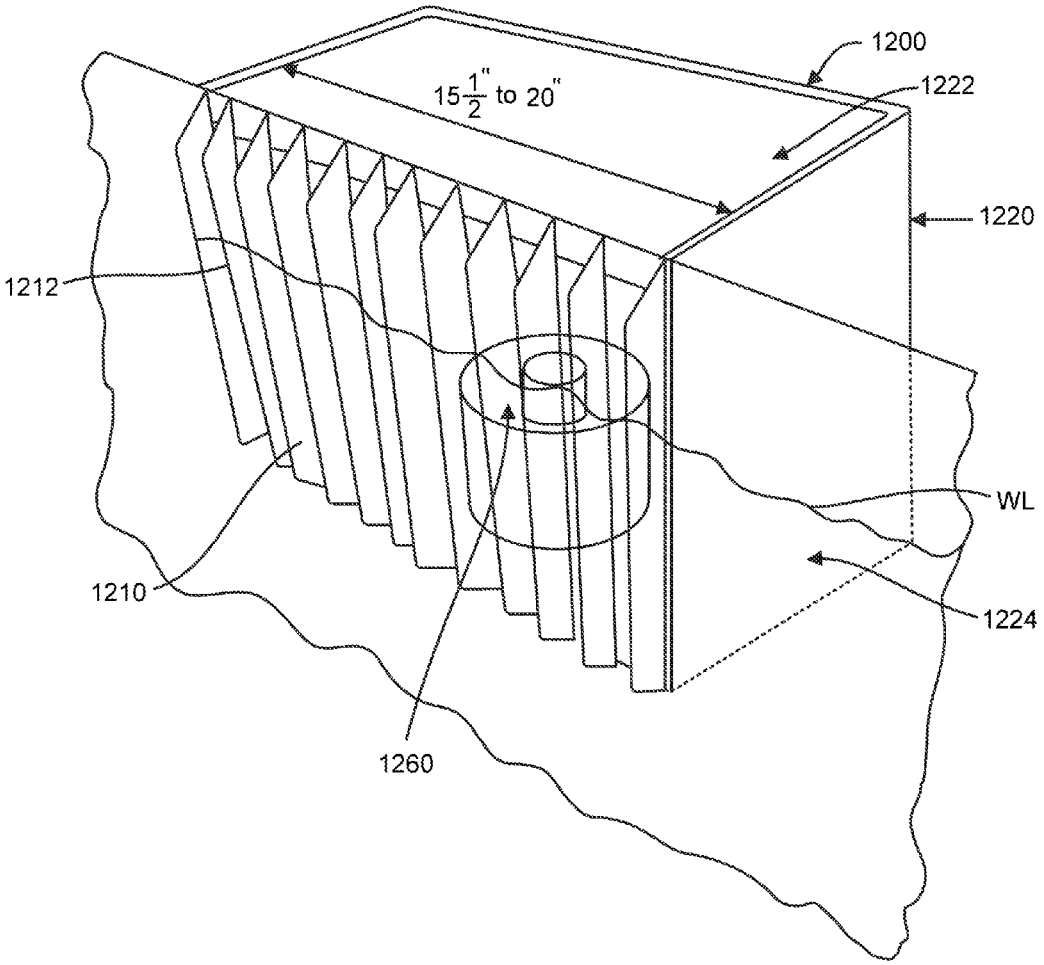
FIG. 8 is a perspective top view of another embodiment of a low gravity fed water system for spas in accordance with aspects of the present invention.

FIG. 8 illustrates another embodiment of a low gravity fed water system 1200 that may be disposed along a side of tub of a spa. Low gravity fed water system 1200 includes a first opening covered by, for example, a grill 1210 such as a vertical bar grill defining an upper chamber 1220 having an upper portion 1222 that extends above a waterline WL in the spa, and a lower portion 1224 which is disposed below waterline WL in the spa.

In one aspect, the grill allows clothing or hair to safely and freely slide up and above the waterlevel without restriction, thereby, reducing the likelihood of clothing, a person's body, and/or hair becoming entrapped or entangled below the waterlevel. A vented service cover (not shown may also be provided for accessing chamber 1220. The features of the vented grill aid in reducing the likelihood a pump (not shown) to create vacuum in the bathing area as well as in chamber 1220. Each of the members 1212 of the grill may be 1½ inches wide and spaced about ¾ inch from each other.

Figure 9:
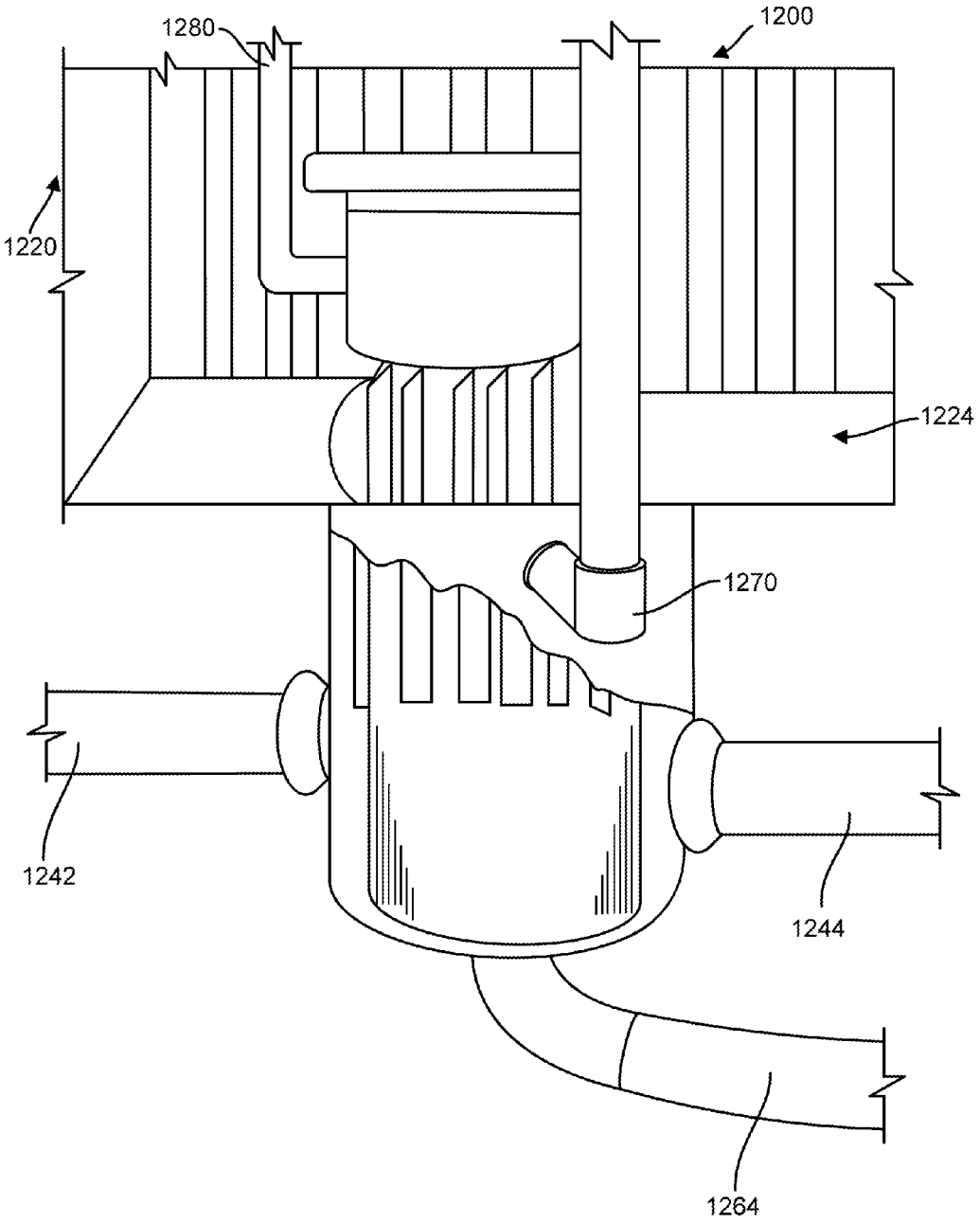
FIG. 9 is a front elevational view of the low gravity fed water system of FIG. 8.
Figure 10:
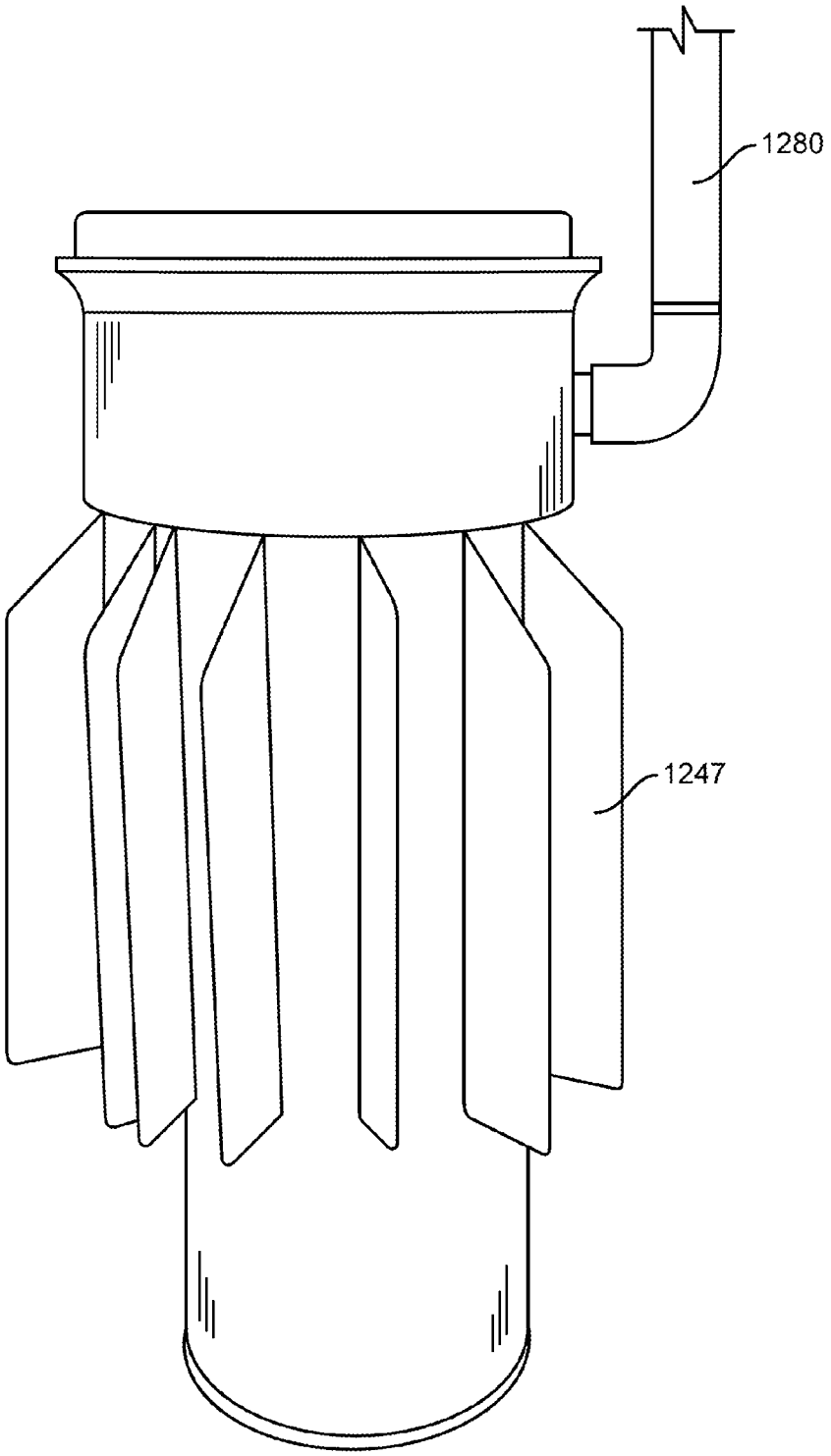
FIG. 10 is a perspective view of the filter assembly having fins for the low gravity fed water system of FIG. 8.
Figure 11:
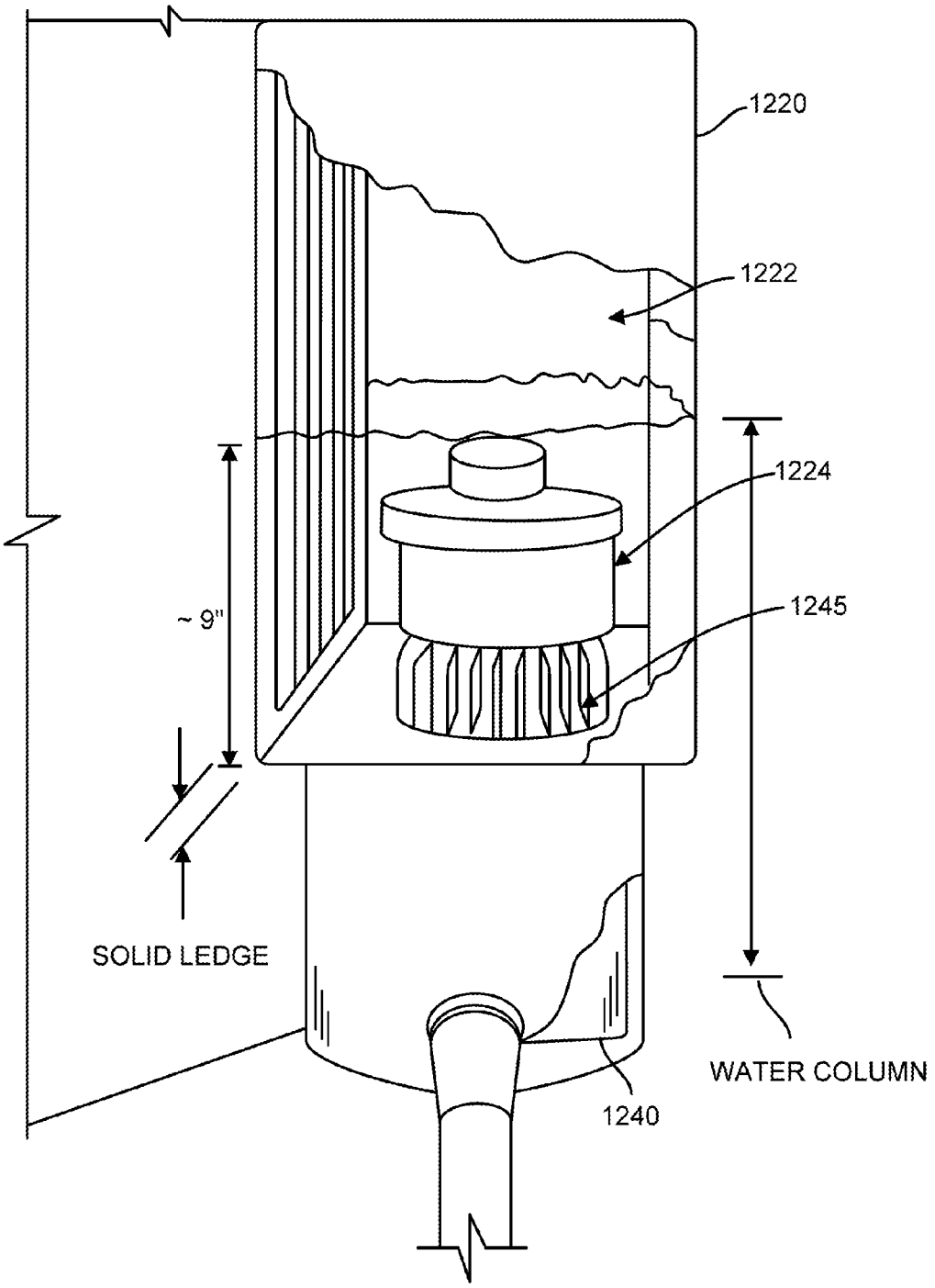
FIG. 11 is a side elevation view of the low gravity fed water system of FIG. 8.

With reference to FIG. 9, water is gravity fed from lower portion 1224 of upper chamber 1220 to a lower chamber 1240 via an intermediate opening or inlet such as an annular opening 1245 (best shown in FIG. 11). For example, as shown in FIG. 10, a plurality of vertically disposed, radially extending, spaced-apart fins 1247 may be disposed in annular opening 1245 (FIG. 11) for receiving water from the spa or pool. The falling water between the fins reduces the likelihood of the possibility of water creating a vortex. In one embodiment, 1247 fins may be employed, with each fin being about 1½ inches wide, about ¼ inch thick, and about 8 inches long. The lower chamber 1240 (FIG. 9) may have an outside diameter of about 10 inches (about 9½ inched inside diameter) and be 12 inches high.

With reference again to FIG. 9, water gravity fed into lower chamber 1240 may be carried via conduits 1242 and 1244 (which are operably connected to tubes) to one or more pumps. Water may also be gravity fed into a filter assembly via an opening or inlet 1262 (FIG. 8). Water filtered in filter assembly is carried via a conduit 1264 to one or more pumps. The water pumped by one or more pumps is returned to the bathing chamber of the spa via suitable tubes to a plurality of jets.

In one aspect of the present invention, in the event that grill 1210 (FIG. 8) becomes clogged or blocked, the vacuum in lower chamber 1240 will be emptied by a vacuum release 1270 such as a conduit which vents lower chamber 1240 to the atmosphere above the water line. A second vacuum release 1280 may be provided for venting the filter. For example, if only inlet 1262 is clogged or blocked, the vacuum in filter assembly 1260 will be emptied by vacuum release 1280 such as a conduit which vents filter assembly 1260 to the atmosphere above the water line. From the present description and as illustrated in FIG. 9, release vent 1270 may be effective to vent both lower chamber 1240 and filter assembly 1260. The vents may be freely open to the atmospheric air at their upper ends and throughout the vent, i.e., not having a valve or other mechanism that moves or otherwise operates to open the vent upon blockage of the low gravity fed water system.

Figure 12:
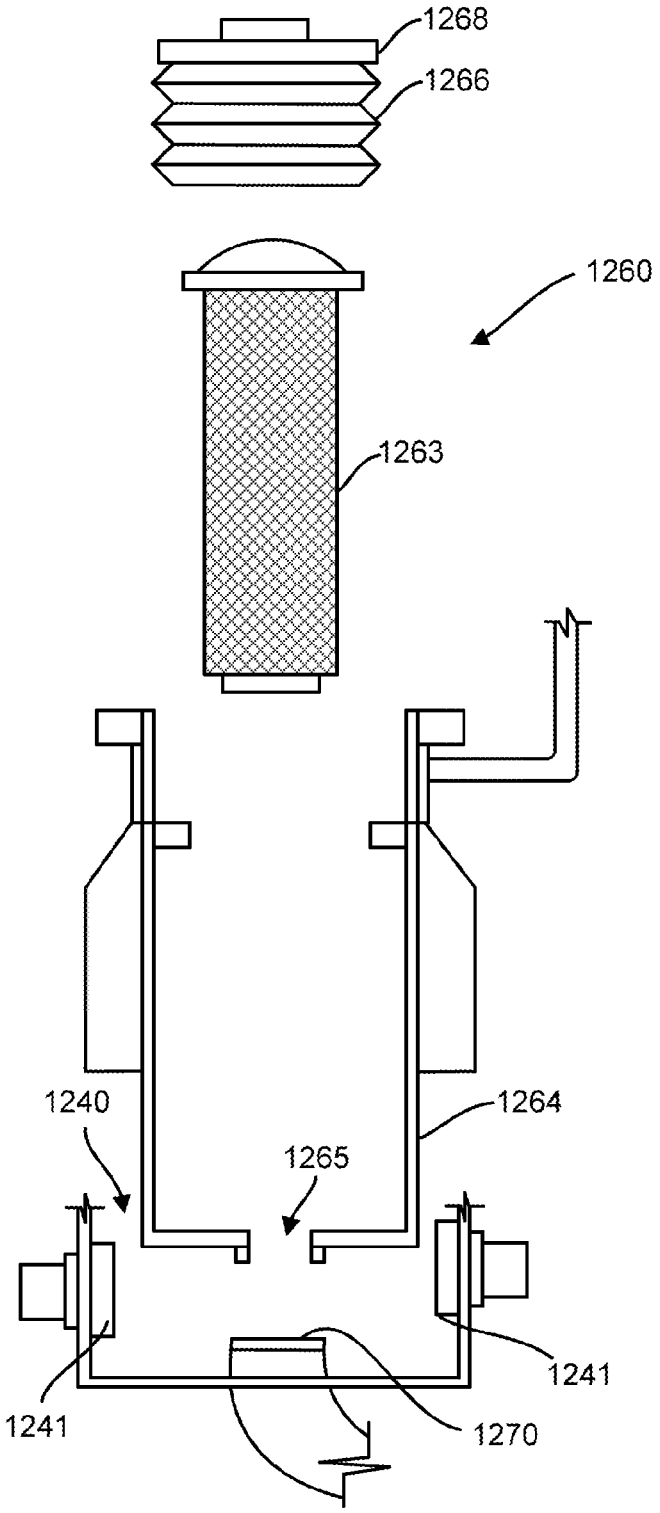
FIG. 12 is an exploded view of the filter assembly for the low gravity fed water system of FIG. 8.

With reference to FIG. 12, another aspect of the present invention includes filter system 1260 having a filter 1263 disposed in a filter housing 1264, which filter housing 1264 is disposed in chamber 1240. For example, disposed between the outer surface of filter housing and inner surface of the lower portion of the housing is lower chamber 1240 having an annular configuration. The filter housing may have an outside diameter of about 5½ inches. The filter may have a flow rate of about 25 gallons per minute to about 50 gallons per minute.

A strainer 1266 may be disposed in filter housing 1264 and covered with a cover 1268. The bottom of the filter may sealably engage the bottom of the filter housing. The bottom of filter housing 1264 may having an opening 1265 which is engagable with a fitting 1270 disposed at the bottom of chamber 1240. Such a configuration of the filter systems results in a user being able to lift the filter housing out of chamber 1240, and wherein any debris loosely disposed on the outside of filter 1262 is maintained in filter housing 1264. The user is able to move the filter housing and filter outside the spa, and then remove and replace the filter without allowing any debris entering the lower chamber.

Figure 13:
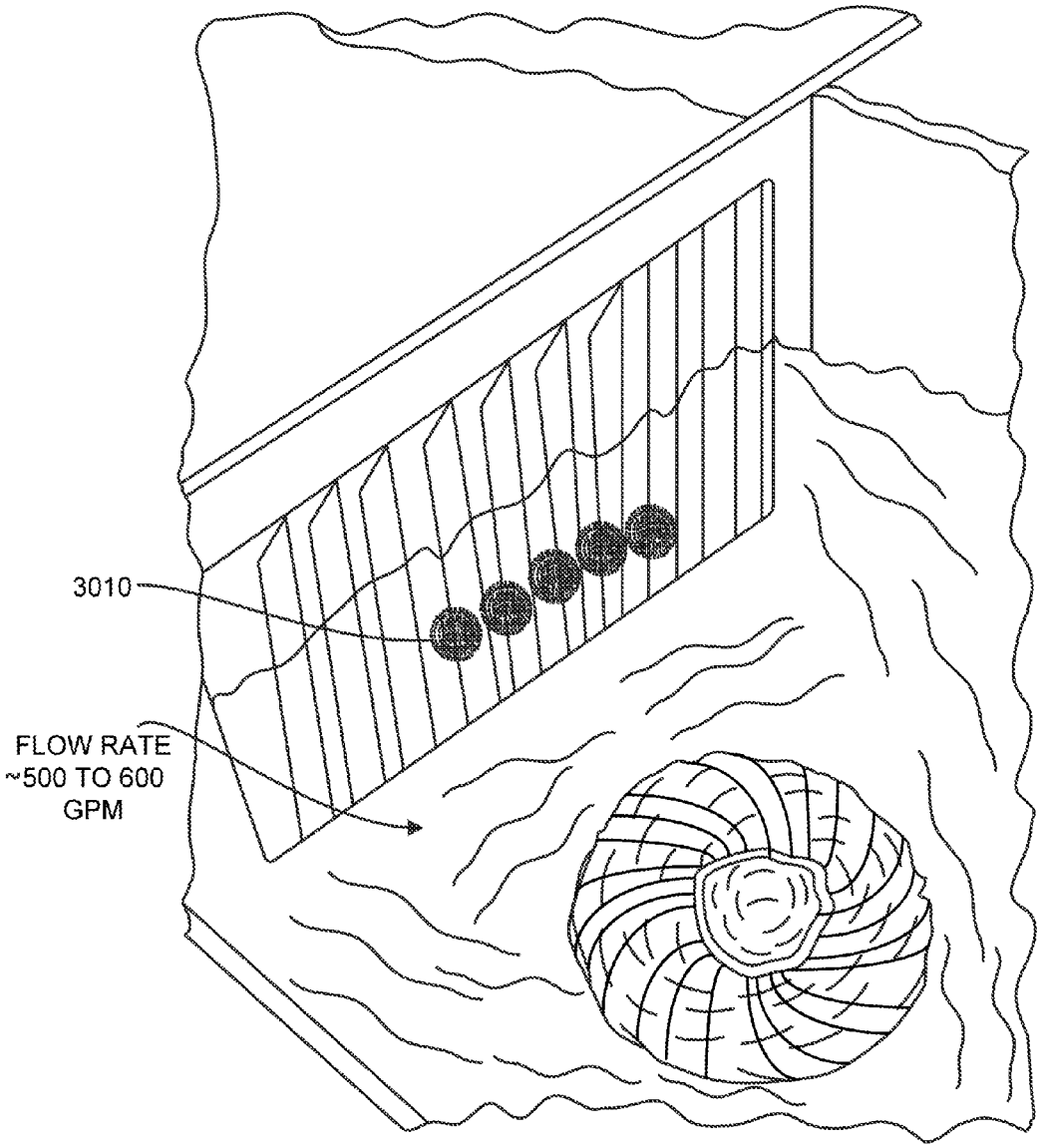
FIG. 13 is a perspective view of an article of clothing disposed against a grill in the low gravity fed water system of FIG. 8.
Figure 14:
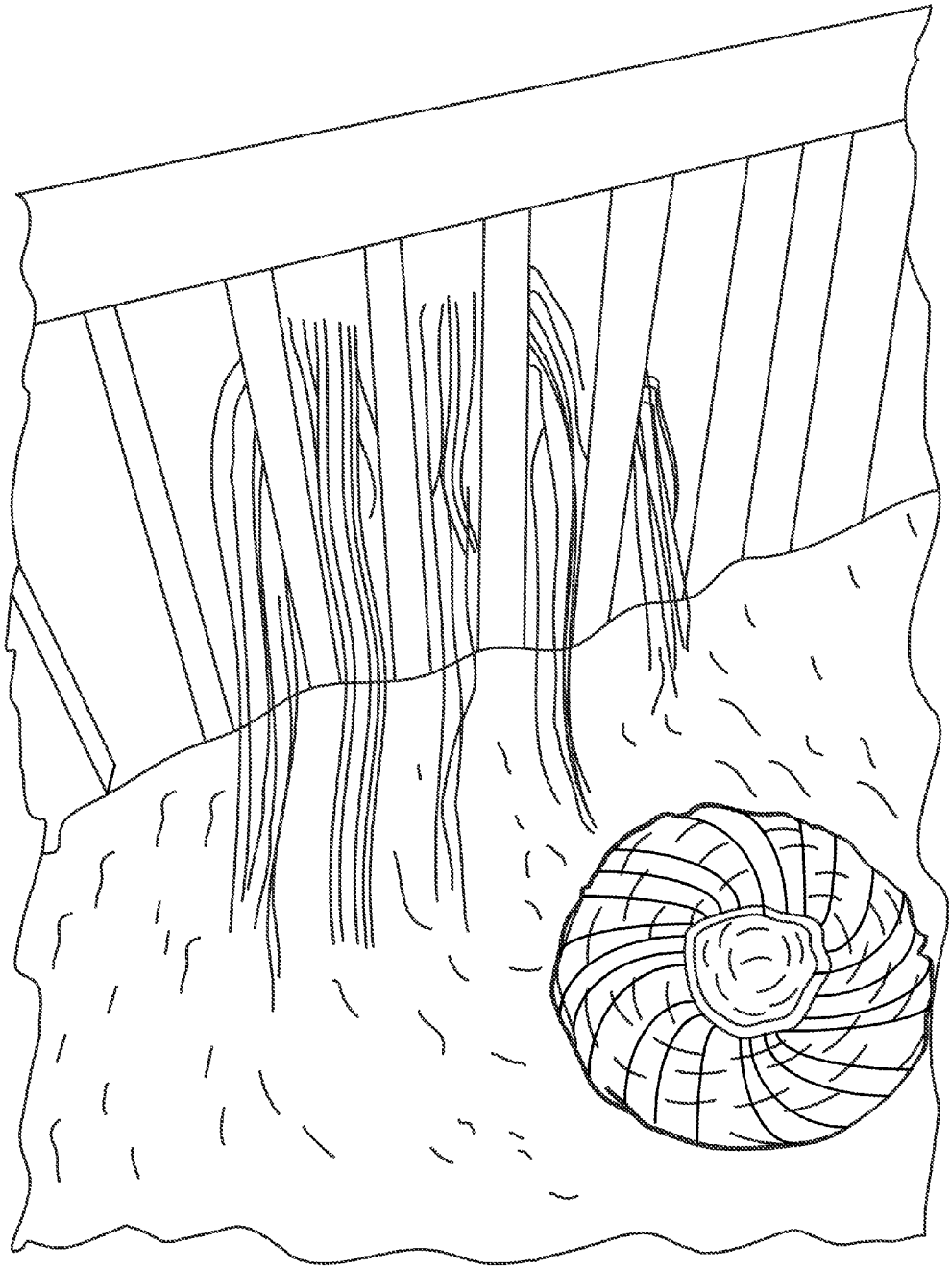
FIGS. 14 and 15 are perspective views of a person's hair disposed against a grill and in the housing of the low gravity fed water system of FIG. 8.
Figure 15:
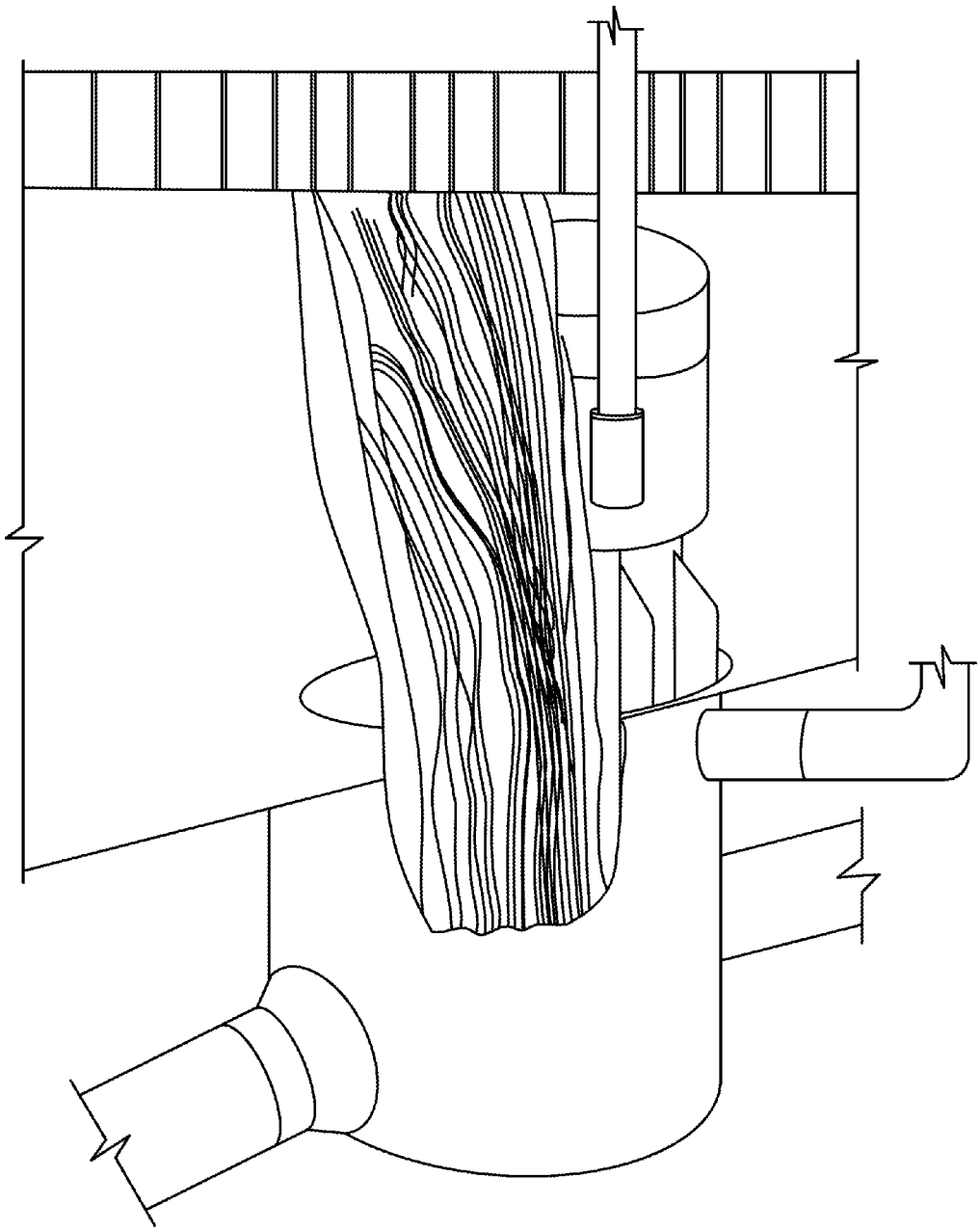

With reference to FIGS. 13-15, therein illustrations are images of the low gravity fed water system in operation in accordance with aspects of the present invention. For example, in FIG. 13, an item of clothing 3010 may float and be lightly retained against the grill. In testing of the system, it has been found that such clothing may be easily pulled away horizontally from the grill and or easily lifted vertically from the grill.

FIGS. 14 and 15 illustrate the effect of hair in the low gravity fed water system in the event that a person comes too close to the grill. As illustrated in FIG. 14, some of the hair divides and extends through the grill without tangling up on the inside of the grill. In testing of the system, it has been found that such hair may be easily pulled away horizontally from the grill and or easily lifted vertically from the grill.

In the event that the person's hair is long enough and extend into the annular space in the lower chamber, as shown in FIG. 15, it has been found that such hair remains straight without tangling due to the fins disposed on the outside of the filter housing, e.g., the flow is a laminar flow or streamline flow, where the water generally flows in parallel layers, with no disruption between the layers, and the hair can be easily pulled away the grill.

With reference again to FIGS. 2, 4, 5, 6, and 12, in another aspect of the present invention, approved suctions or drain covers may be disposed in the low gravity fed water system. For example, the approved suction or drain covers may (e.g., cover 241 (FIG. 2), 341 (FIG. 4), 541 (FIG. 5), and 641 (FIG. 6), and 1241 (FIG. 12) may cover the openings in the lower chamber which connect to the conduits or tubes which lead to the pumps. Approved suction or drain covers satisfying the Virginia Graeme Baker Pool and Spa Safety Act or other compliance regulations that are or may be implemented may be employed. For example, a plurality of 5" Ultra Flow Suctions having a rating of 260 GPM, model no. 640-3937 V, available from Waterway Plastics, Oxnard, Calif., may be suitably employed.

In addition, the front of the grill may be curved to make it harder for objects and people to block the entry of water entering the low gravity fed water system. While the system is shown having a round lower chamber, it will be appreciated that other configurations maybe suitably employed. For example, the lower chamber may be square or rectangular. The fins may have different sizes to extend between the housing of the filter and the inside of the lower housing. In addition, a rectangular chamber may be attached to the cylindrical housing so that the flat ends of the rectangular chamber may be easily connected to the tubes to the pumps and easily covered by a suction or drain cover. From the present description, it will be appreciated that other configuration may be suitably employed.

In testing, it has been found that when a conventional spa is operated with submersed drains in the bathing area and the drains are obstructed, the vacuum in the system goes up thereby increasing the hold between the obstructed object and the drain, e.g., −20 to −25 Hg. In testing a low gravity fed water system of the present invention, which includes a safety tube to allow air into the system when the entry of water is obstructed at the grill or water is obstructed around the annular opening to the lower chamber, the vacuum will be about 0 Hg, making it easier for the obstructed item to be removed. In the event that an object obstructs the filter opening, the low flow rate of the filter allows the obstructed object to be readily removed. In addition, employing the safety tube for the filter as described above also reduces the vacuum on the obstructed opening. If a safety tube is used on the filter, a greater flow rate may be used in the filter.

Figure 16:
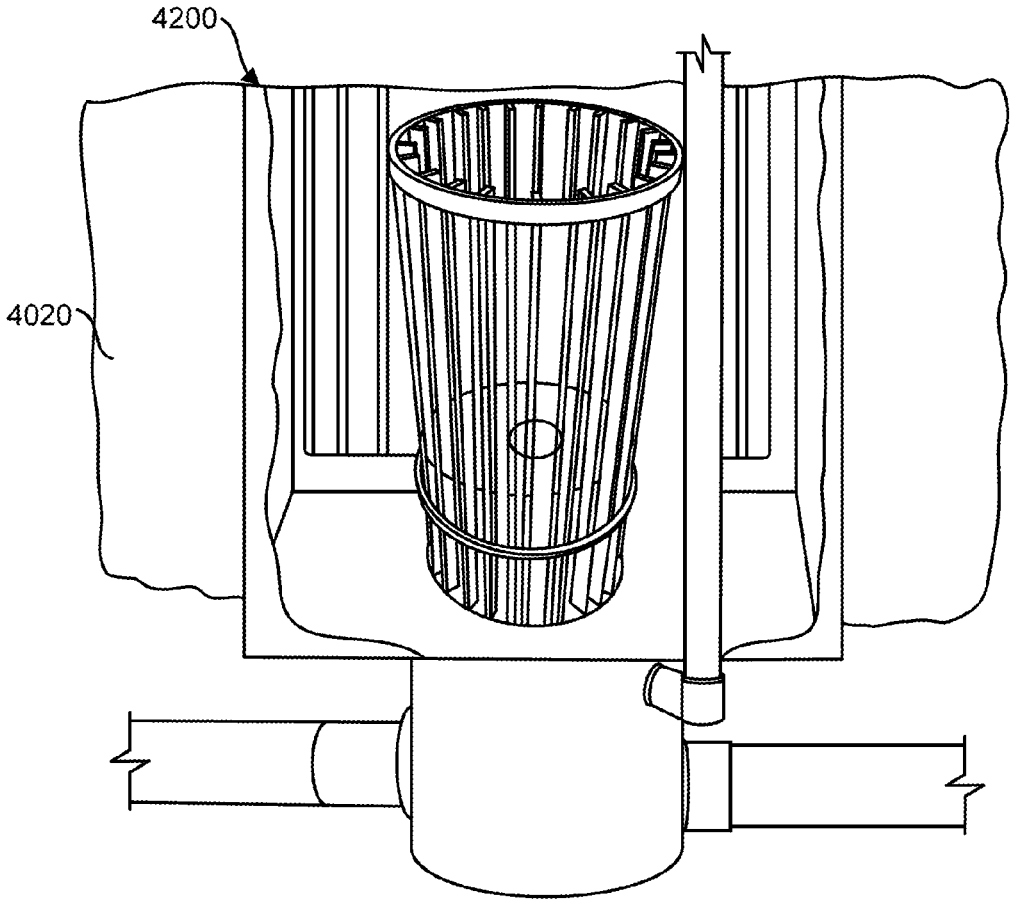
FIG. 16 is another embodiment of a low gravity fed water system in accordance with aspects of the present invention.

FIG. 16 illustrates another embodiment of a low gravity fed water system 4200 with the drains disposed outside the bathing chamber in accordance with aspects of the present invention. Low gravity fed water system 4200 may be disposed along a side of a tub 4020. As best shown in FIGS.

Figure 17:
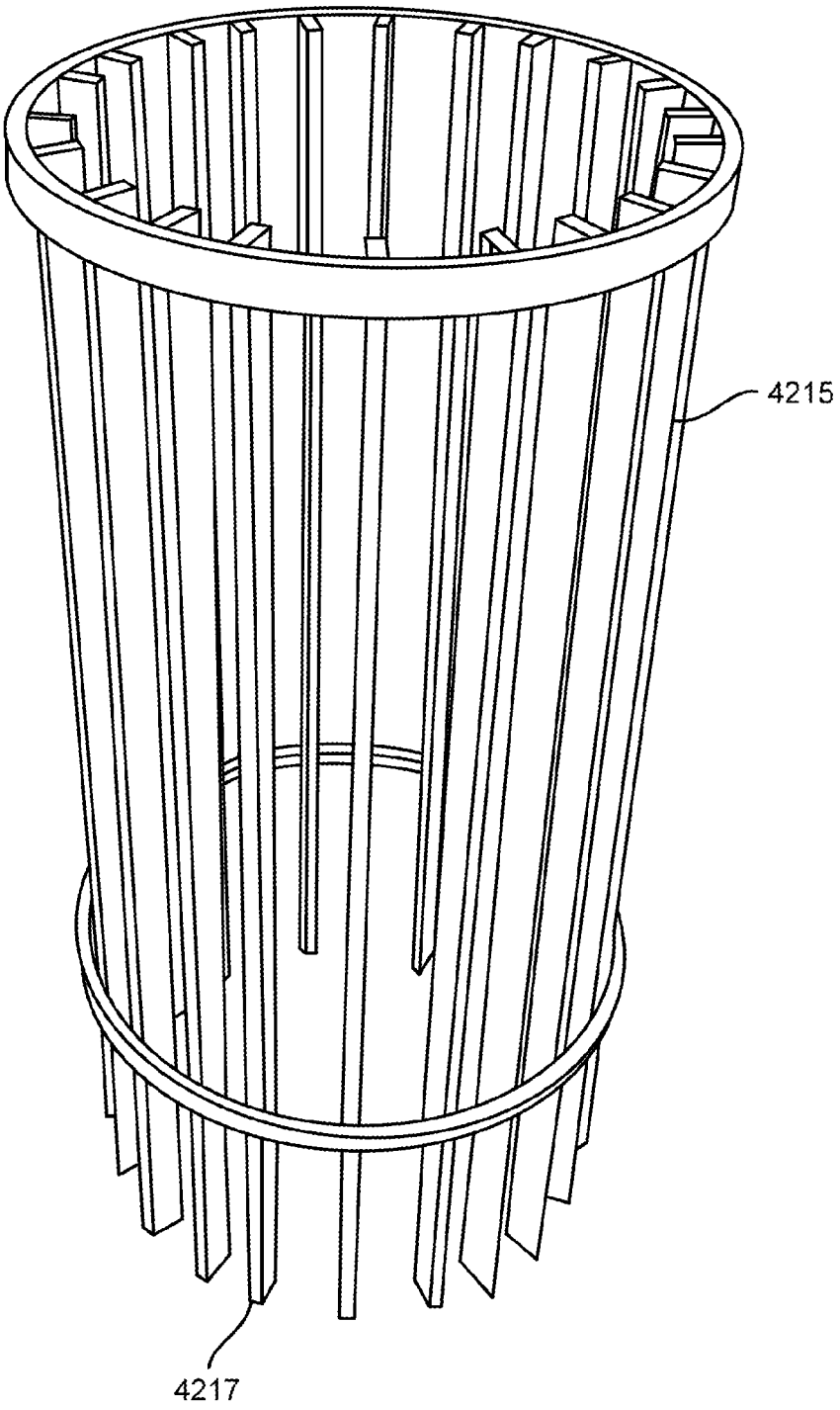
FIG. 17 is an enlarged view of a portion of a grill used in the low gravity fed water system of FIG. 16.

16 and 17, low gravity fed water system 4200 includes an intermediate inlet opening covered by, for example, a cylindrical grill 4215 (FIG. 17) having vertical bars 4217 (FIG. 17). Cylindrical grill 4215 extends around the filter assembly, and above the waterline. The top of the cylindrical grill 4215 may be covered with a solid top, a grill, other structure, and combinations thereof.

Figure 18:
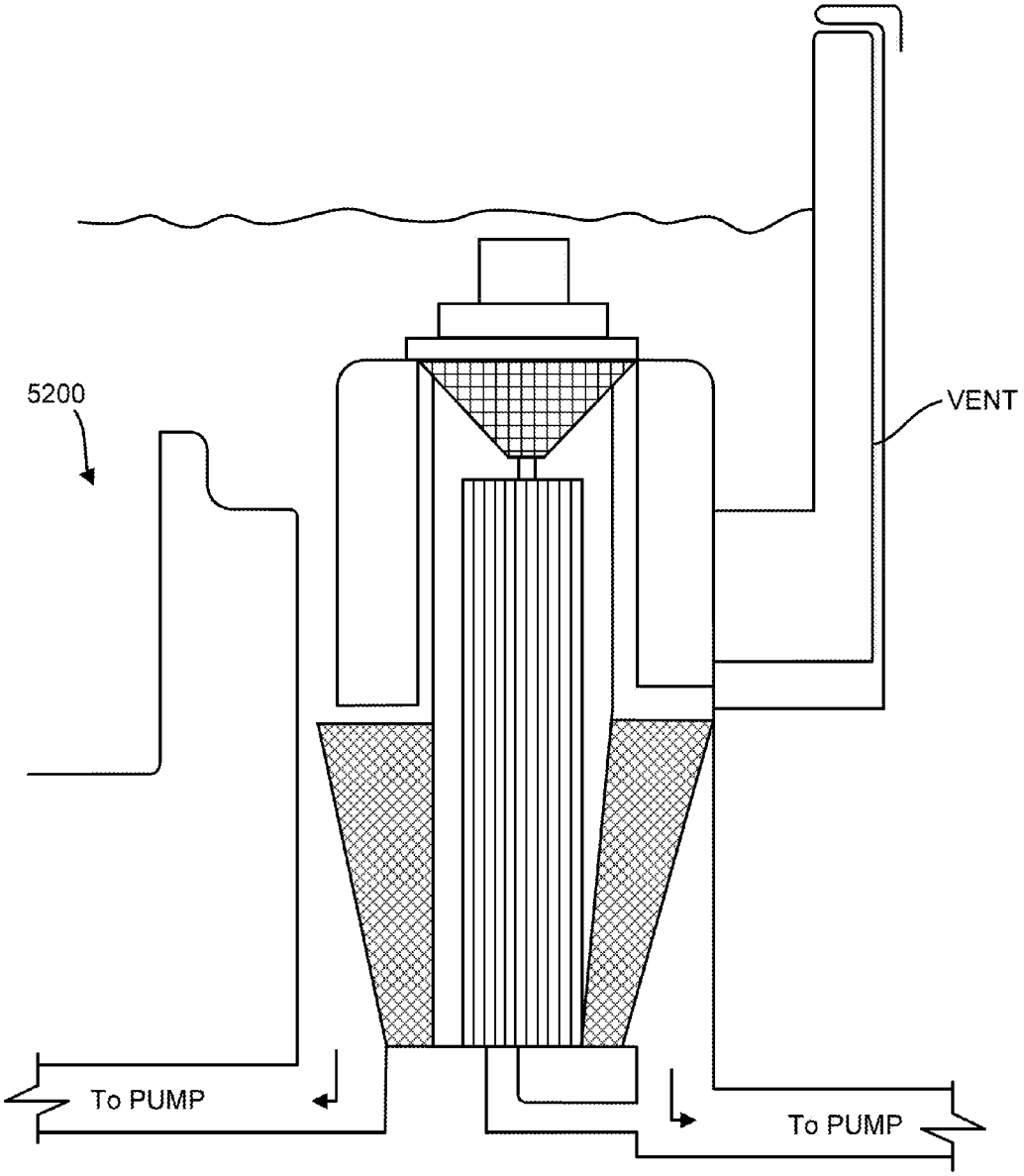
FIG. 18 illustrates another embodiment of a low gravity fed water system for spas in accordance with aspects of the present invention.

FIG. 18 illustrates another embodiment of a low gravity fed water system 5200 for spas in accordance with aspects of the present invention. In this embodiment, the grill for the filter and the grill around the lower portion of the filter comprise a conical configuration. The top of the filter inlet may be disposed just below the waterline. The grill may surround the housing of the filter. An additional cover or grill (not shown) may cover the filter. Such a cover or grill may or may not be needed. Such a configuration may be readily retrofit into existing filter/filter chambers in conventional spas.

Figure 19:
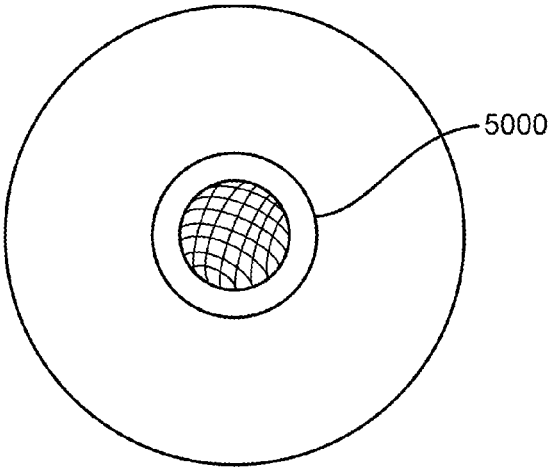
FIG. 19 is a top view of grill for covering the return for a filter in accordance with aspects of the present invention.

FIG. 19 is a top view of grill for covering the return for the filter in accordance with aspects of the present invention. For example, a raised curved grill or mesh may be used to cover the opening or return of water filtered in the filter. This configuration may reduce the likelihood of a suction being drawn on the opening when removing the filter housing for cleaning or replacement and operating the pump at the same time.

Figure 20:
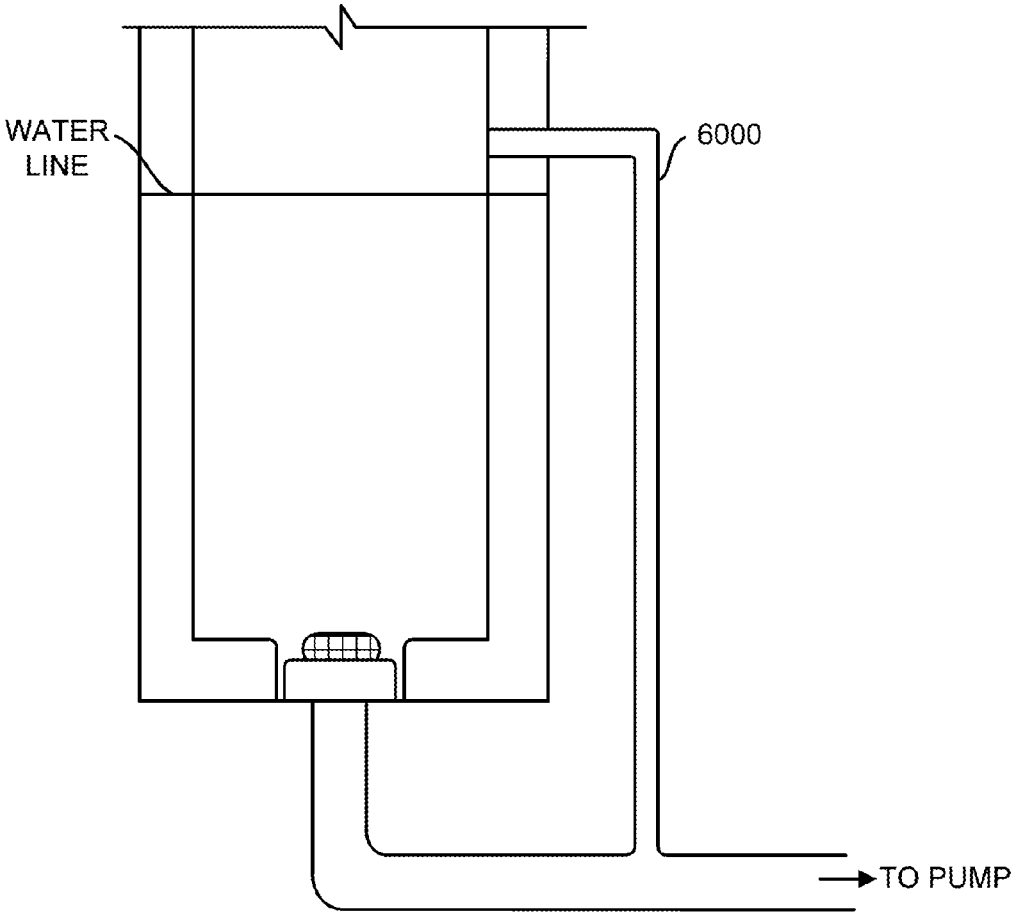
FIG. 20 is a side elevational view of the filter housing and a safety tube operable when the filter housing is removed for cleaning or replacement in accordance with aspects of the present invention.

In addition, as shown in FIG. 20, illustrates another configuration for reducing the likelihood of a suction being drawn on the opening when removing the filter housing for cleaning or replacement and operating the pump at the same time. For example, a tube 6000 may be connected at a lower end to the water return to the pump from the filter. An upper end may extend through the outer portion of the chamber above the water and be disposed to sealing engage the outer surface of the filter housing. Thus, if the filter housing is removed while the pump is operating and the lower outlet is blocked or obstructed, the air will be drawn through tube 6000 to reduce the suction drawn on the instructed inlet. It will be appreciated that other means may be provided or reducing the likelihood of a suction being drawn at the bottom of the chamber when the filter housing is removed. For example, magnetic or electrical switches may be employed to preventing the pump form operating when the filter housing is removed.

Figure 21:
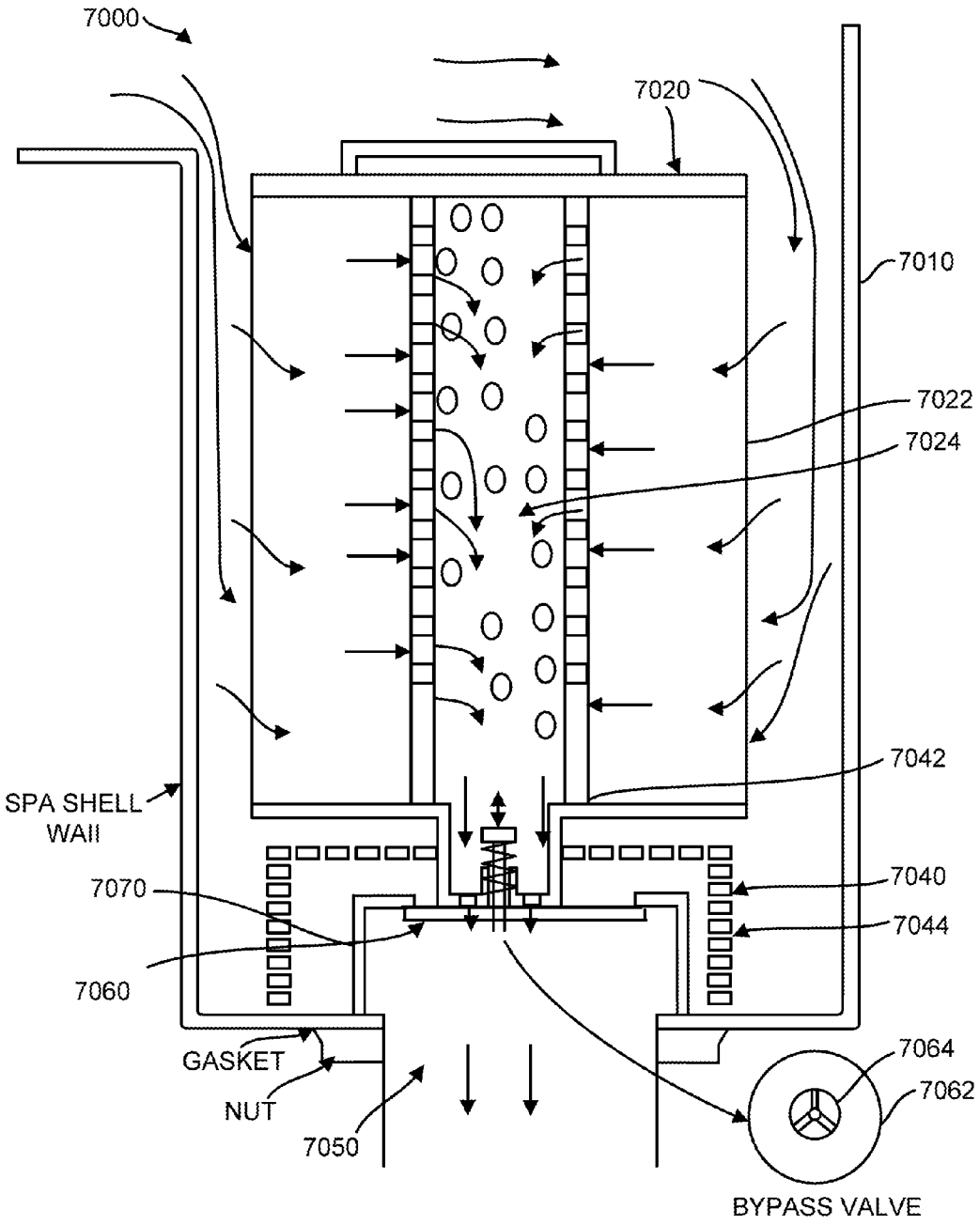
FIGS. 21 and 22 are cross-sectional views of an embodiment of a filter system having a check valve for use in a low gravity fed water system for spas in accordance with aspects of the present invention.
Figure 22:
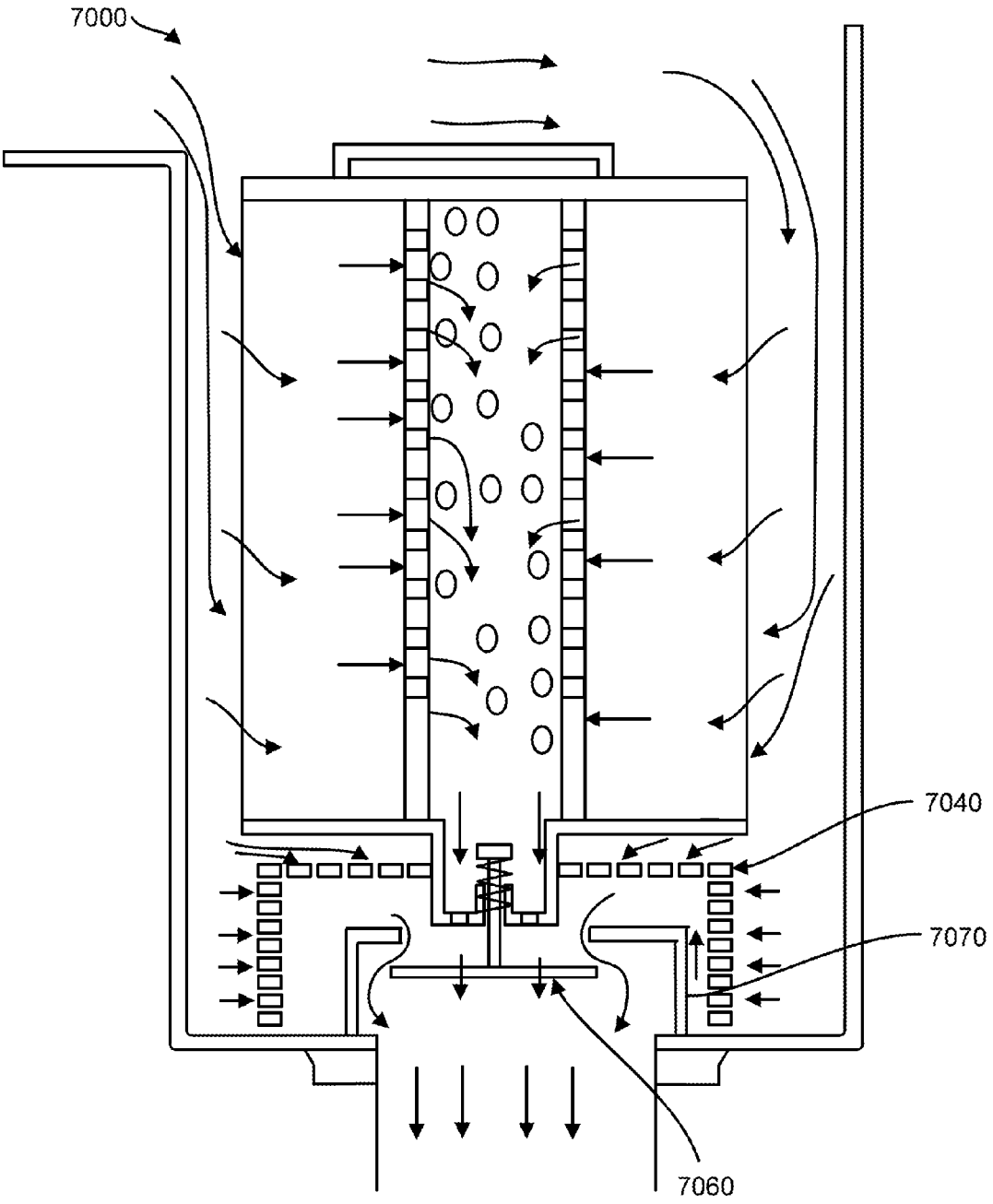
Figure 23:
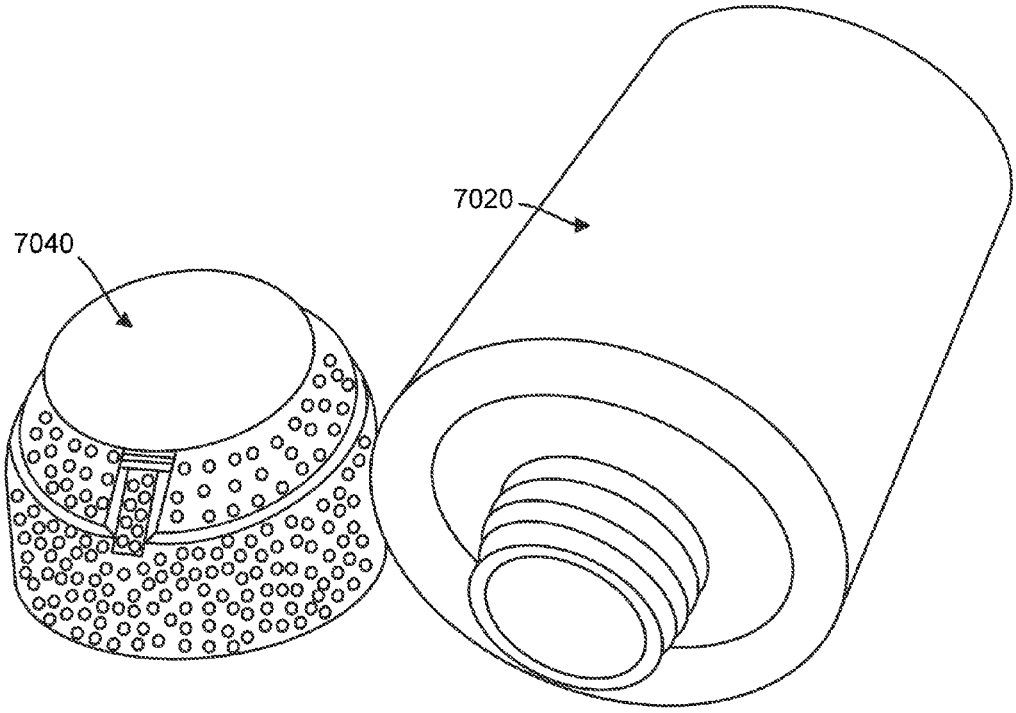
FIG. 23 is a perspective view of the filter device and the filter mount of FIGS. 21 and 22.

FIGS. 21 and 22 illustrate an embodiment of a filter system 7000 for use in the low gravity fed water system for spas in accordance with aspects of the present invention. In FIG. 21, filter system 7000 is illustrated as operating under a low flow rate of water, e.g., about 0 to about 50 gallons per minute such as when the pump is operated and the spa is not being used. FIG. 22 illustrates filter system 7000 operating under a high flow rate of water, e.g., greater than 50 and desirably about 200 to about 450 gallons per minute or more such as when the pump is operated to provide sufficient water for the spa jets when the spa is being used. FIG. 23 further illustrates the filter device and the filter mount.

With reference again to FIG. 21, filter system 7000 may include a filter housing 7010 which may be a portion of the spa shell wall defining a chamber, a filter device 7020 disposed in the chamber defined by the housing, a filter mount 7040 operably connectable to the filter device and to the housing around an opening 7050 connected via a conduit to a pump (not shown).

Filter device 7020 may include a filter 7022 defining a passageway 7024 for transporting filtered water therethrough. Filter mount 7040 may include an opening 7042 fluidly connectable to passageway 7024. Filter mount 7040 may also include a plurality of openings 7044 such as holes for transporting unfiltered fluid, as described below.

A check valve 7060 may be disposed in filter mount 7040 across the lower end of passageway 7024. Check valve 7060 may have a first normally closed position, as shown in FIG. 21, operable for allowing filtered water to pass through the filter system to a pump and inhibit passage of unfiltered water through said filter system to the pump. For example, check valve 7060 may include a disc-shaped member 7062 having an opening 7064 which allows filtered water to pass through. A filter fitting 7026 may be disposed at the end of passageway 7024 which includes a support for receiving a movable pin and a spring for biasing disc-shaped member 7062 in the normally closed position. For example, the check valve may be operable to permit filtered water to pass through the filter system, via the opening in filter fitting 7026, and opening 7064 in disc-shaped member 7062, to a pump. In the normally closed position, the peripheral edge portion of disc-shaped member engages an opening defined by an inverted L-shaped wall 7070, e.g., a cylindrical member having a horizontally extending upper portion. When the check valve in the normally closed position, the disc-shaped valve 7060 and wall 7070 inhibit passage of unfiltered water through the filter system to the pump at low flow rates to the pump of less than about 50 gallons per minute.

With reference to again to FIG. 22, filter system 7000 is disposed in a second configuration operating under an increased flow rate of water such as a flow rate greater than about 50 gallons per minute, and up to about 400 gallons per minute to about 600 gallons per minute for supplying water to the jets. For example, disc-shaped-member 7062 of check valve 7060 will be pulled downwardly due to the increased flow of water, thereby allowing filtered water to be drawn to the pump, and allowing unfiltered water to pass through filter mount 7040, and between the upper portion of wall 7070 and the peripheral edge portion of disc-shaped member 7060 to also be drawn to the pump.

From the present description, it will be appreciated that after a period of use of the filter system, the filter may slowly become clogged. As the filter becomes clogged, the check valve may open slightly and permit unfiltered water to pass through, for example, when the pump is operated in a low flow rate when the spa is not being used. As noted above, the housing surrounding the filter device, the filter mount, and the check valve may comprises a portion of the spa shell wall of the spa or pool.

Figure 24:
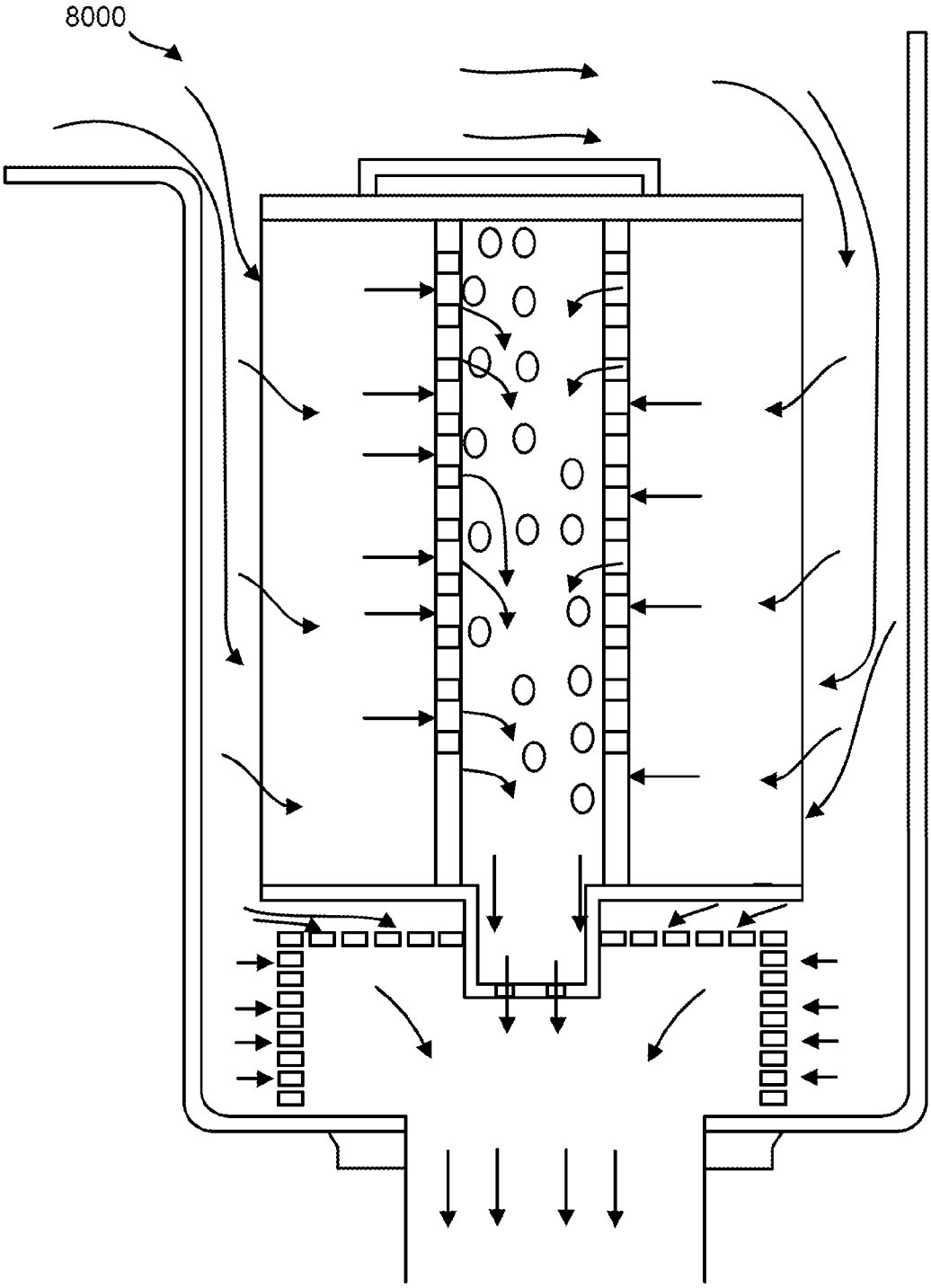
FIG. 24 is a cross-sectional view of another embodiment of a filter system for use in a low gravity fed water system for spas in accordance with an aspect of the present invention.

FIG. 24 illustrates another embodiment of a filter system 8000 for use in the low gravity fed water system for spas in accordance with aspects of the present invention. Filter system 8000 is essentially the same as filter system 7000 without the check valve and the inverted L-shaped wall 7070. In operation, water is drawn though the filter and also around the filter during low and high flow rates. A cover or grill may extend over or around the filter system as described above.

Figure 25:
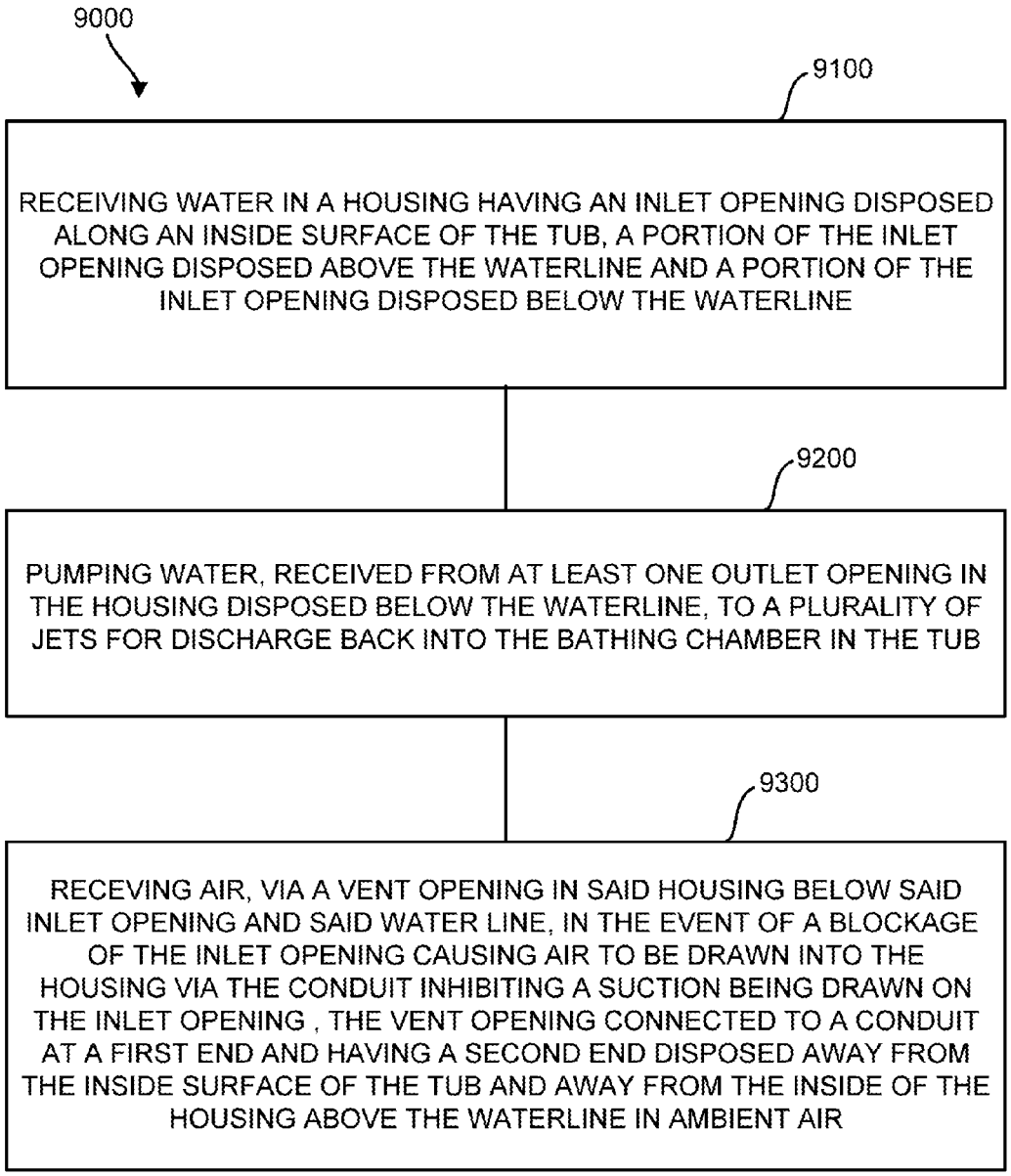
FIG. 25 is one embodiment of a method for circulating water in a pool or spa having no completely submersed openings in the bathing chamber of the pool or spa for receiving water during operation of pumping water to a plurality of jets in the bathing area in accordance with aspects of the present invention.

FIG. 25 illustrates a method 9000 for circulating water in a pool or spa having no completely submersed openings in the bathing chamber of the pool or spa for receiving water during operation of pumping water to a plurality of jets in the bathing area. The method includes at 9100, receiving water in a housing having an inlet opening disposed along an inside surface of the tub. A portion of the inlet opening is disposed above the waterline and a portion of the inlet opening is disposed below the waterline. At 9200, water received from the at least one outlet opening in the housing disposed below the waterline is pumped to a plurality of jets for discharge back into the bathing chamber in the tub. At 9300, air is received, via a vent opening in said housing below said inlet opening and below the waterline in the event of a blockage of the inlet opening causing air to be drawn into the housing via the conduit inhibiting a suction being drawn on the inlet opening. The vent opening is connected to a conduit at a first end and having a second end is disposed away from the inside surface of the tub and away from the inside of the housing above the waterline in ambient air.

In the various embodiments, the first opening in the housing along the waterline may be about 20 inches wide, and have a height of about 16 inches to provide a water head of about 6 to 8 inches. The housing may have a depth of about 14 inches that extends behind the first opening. When bathers enter the spa or pool, the height of the water head may increase about 1 inch to about or 2 inches. These dimensions may vary depending on gallon per minute flow rate requirements for each individual spa and pool. In addition, the sizing of the housing and opening may be selected so that the likelihood of the pumps drawings air is avoided. The rate of flow may be between about 20 gallons per minute and 600 gallons per minute, but may vary depending on the pump size and number of pumps.

For example, the sizing of the opening in the housing (e.g., the width of the opening, and height or head of the water entering the housing) to accommodate the desired flow rate of the pool or spa may be generally calculated using Weir flow calculations.

For example, for rectangular weirs, the flow rate measurement in a rectangular weir may be based on the Bernoulli Equation principles and can be expressed generally as:

$$q=\tfrac{2}{3}c_d b(2g)^{1/2}h^{3/2} \quad (1)$$

where q=flow rate ($m^3/s$), h=head on the weir (m), b=width of the weir (m), gravity g=9.81 ($m/s^2$), and $c_d$=discharge constant for the weir determined by analysis and calibration tests. For standard weirs—$c_d$—is well defined or constant for measuring within specified head ranges.

For rectangular weirs, the flow rate measurement in a rectangular weir may also be based of the Francis Formula, and can be expressed generally as follows:

$$q=3.33(b-0.2h)h^{3/2} \quad (1b)$$

where q=flow rate (ft3/s), h=head on the weir (ft), and w=width of the weir (ft).

Figure 26:
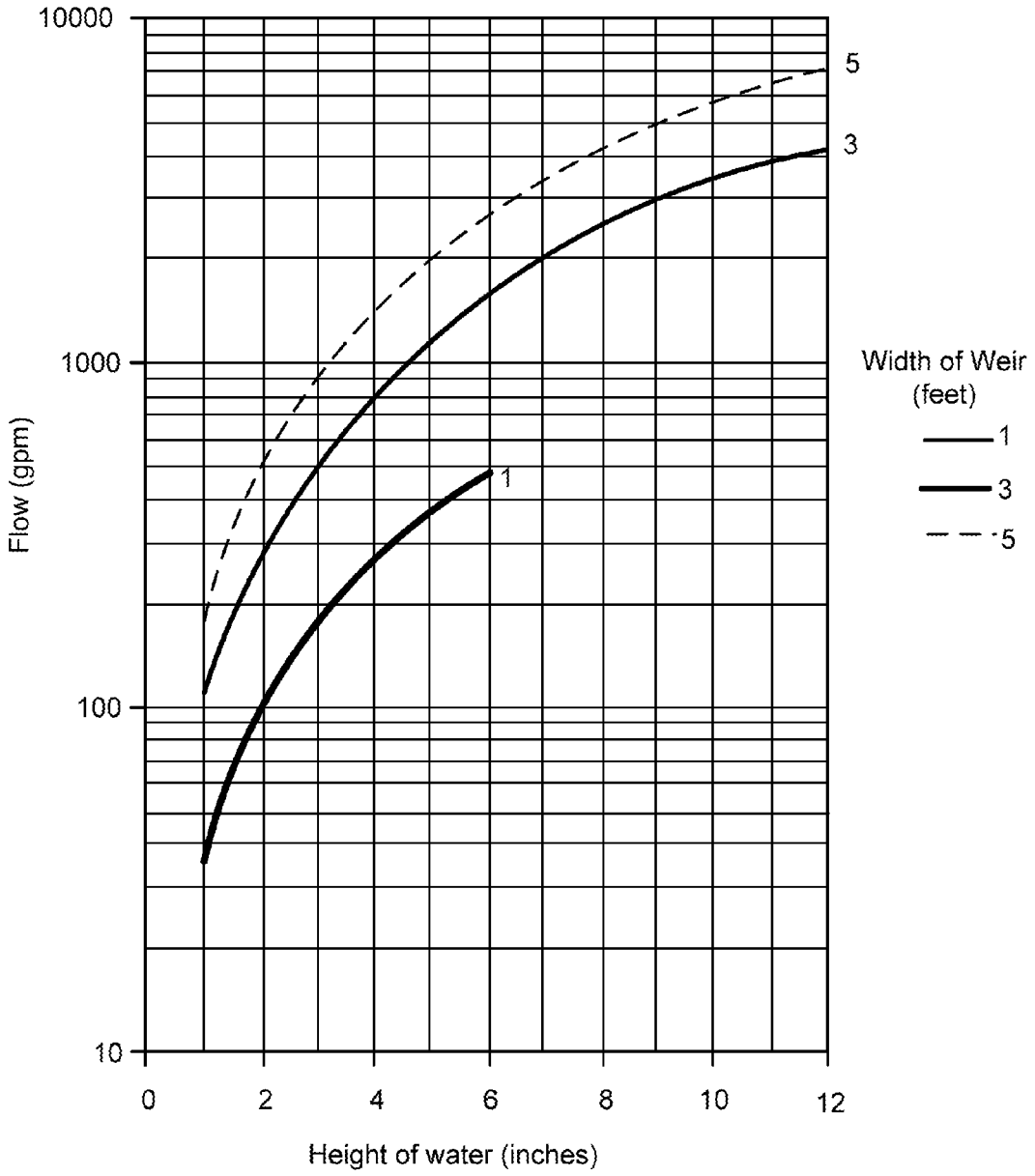
FIG. 26 is a graph of the flow rate verses the height of water for different widths of a weir.

Graphically, the flow rate verses height of water for different widths of a weir is illustrated in FIG. 26.

The opening in the housing may have a width greater than 6 inches, greater than 9 inches, about 12 inches, greater than 1 foot, greater than 18 inches, greater than 20 inches, or greater than 2 feet, for receiving water from the pool or spa.

The height of the head of water entering the opening may be about 6 inches, greater than 6 inches, greater than 9 inches, about 12 inches, or greater than 1 foot, for receiving water from the pool or spa.

While a rectangular configuration is described above, it will be appreciated that the opening in the housing may have any suitable configuration for permitting the desired flow rate.

The low gravity fed water system may be integral with a tub of a pool or spa. In addition, the low gravity fed water system may be a system with allows retrofitting of current pools and spas.

From the present description, the present invention may overcome the danger of entrapment that exists with current pools and spas. For example, by removing submersed suction/drains, entrapment of the bather may be avoided when a bather comes in contact with a suction/drain and cannot escape the vacuum created by the pump such as caused by the bather or bathers' hair or an article of the bathers' clothing being pulled into the suction/drain. Thus, the possible result in injury or even death by drowning may possibly be avoided because of the elimination of suction/drains disposed below the surface of the water in the bathing area.

In addition to the benefit of safety to persons in preventing injury, the present invention may also control and prevent damage to water circulation devices, such as pumps, and may be used to control timed operation of water circulation devices.

Thus, while various embodiments of the present invention have been illustrated and described, it will be appreciated to those skilled in the art that many changes and modifications may be made thereunto without departing from the spirit and scope of the invention.

The invention claimed is:

1. A low gravity fed water system for use in a spa or pool comprising a tub having a plurality of jets disposed in the tub for discharging water into a bathing chamber of the tub, said low gravity fed water system comprising;

a housing;

said housing having at least one inlet disposed below a waterline for receiving water from the spa or pool;

said housing having at least one outlet disposed below said at least one inlet, said at least one outlet operably connectable in fluid communication to a pump and to the plurality of jets;

said housing having at least one vent opening disposed in said housing below said at least one inlet;

an upwardly-extending conduct connectable at a first end to said vent opening, and having a second end above the waterline in ambient air and disposable away from an inside surface of said housing and away from an inside surface of the tub;

wherein in an event of a blockage of said at least one inlet, air is drawn into said housing via said upwardly-extending conduit inhibiting a suction being drawn on said at least one inlet; and a plurality of fins disposed in said housing to reduce a likelihood of water in said housing creating a vortex.

2. The low gravity fed water system of claim 1 further comprising a filter assembly disposable in said housing, said filter assembly comprising a filter housing for containing a filter, wherein a first flow of water in said housing being through said filter housing and a second flow of water being around said filter housing, and wherein said filter assembly being removable from said housing with said filter therein.

3. The low gravity fed water system of claim 2 further comprising a check valve disposed in said housing.

4. The low gravity fed water system of claim 1 further comprising a check valve disposed in said housing.

5. The low gravity fed water system of claim 1 further comprising a filter mount disposable in said housing and operably connectable to a filter device for receiving filtered water in said housing, and comprising a plurality of openings for receiving unfiltered water in said housing.

6. The low gravity fed water system of claim 5 further comprising a check valve disposed in said filter mount having a first position operable for allowing filtered water to pass through said housing and inhibit passage of unfiltered water through said housing, and a second position operable for allowing filtered water to pass through said housing and unfiltered water to pass through said housing.

7. The low gravity fed water system of claim 1 further comprising:

said tub having said plurality of jets disposed in said tub for discharging water into said bathing chamber of said tub, said tub having no completely submersed openings in said bathing chamber for receiving water dischargeable from said plurality of jets; and at least one pump operably connectable to said outlet of said low gravity fed water system for receiving water from said housing and discharging water from said plurality of jets.

8. The low gravity fed water system of claim 7 wherein said tub and said housing being configured so that water entering said low gravity fed water system has a water head height of about 5 to about 10 inches, and a flow rate of water though said housing is greater than 100 gallons per minute.

9. The low gravity fed water system of claim 7 further comprising a grill covering at least one of said at least one inlet.

10. The low gravity fed water system of claim 7 wherein said housing is integrally formed with said tub, and said second end of said upwardly-extending conduit is covered by a lip of said tub.

11. A low gravity fed water system for use in a spa or pool comprising a tub having a plurality of jets disposed in the tub for discharging water into a bathing chamber of the tub, said low gravity fed water system comprising;

a housing;

said housing having at least one inlet disposed below a waterline for receiving water from the spa or pool;

said housing having at least one outlet disposed below said at least one inlet, said at least one outlet operably connectable in fluid communication to a pump and to the plurality of jets; and wherein a flow of water through said housing comprises a first flow and a second flow, and wherein at least a portion of the second flow of water from said at least one inlet to said outlet being generally separate from the first flow of water from said at least one inlet to said outlet; and a plurality of fins disposed in said housing to reduce a likelihood of the second flow of water in said housing creating a vortex.

12. The low gravity fed water system of claim 11 further comprising a filter disposable in the first flow of water, and wherein the first flow of water comprises filtered water and the second flow of water comprises unfiltered water.

13. The low gravity fed water system of claim 11 wherein the first flow of water through said housing is entirely separate from the second flow of water through said housing.

14. The low gravity fed water system of claim 12 further comprising a check valve having a first position operable for inhibiting the second flow of water, and a second position operable for allowing the second flow of water.

15. The low gravity fed water system of claim 11 further comprising a check valve having a first position operable for inhibiting the second flow of water, and a second position operable for allowing the second flow of water.

16. The low gravity fed water system of claim 11 further comprising a filter mount disposable in said housing and operably connectable to a filter device for receiving the first flow of water being filtered water, and comprising a plurality of openings for receiving the second flow of water being unfiltered water.

17. The low gravity fed water system of claim 16 wherein said low gravity fed water system comprises said filter disposable in the first flow of water, and wherein the first flow of water comprises filtered water and the second flow of water comprises unfiltered water.

18. The low gravity fed water system of claim 11 wherein said housing comprising at least one vent opening disposed in said housing below said inlet, and further comprising an upwardly-extending conduct connectable at a first end to said vent opening, and having a second end above the waterline in ambient air and disposed away from an inside surface of said housing and away from an inside surface of said tub, and wherein in an event of a blockage of said at least one inlet air is drawn into said housing via said upwardly-extending conduit inhibiting a suction being drawn on said at least one inlet.

19. The low gravity fed water system of claim 11 further comprising:

said tub having said plurality of jets disposed in said tub for discharging water into said bathing chamber of said tub, said tub having no completely submersed openings in said bathing chamber for receiving water dischargeable from said plurality of jets; and at least one pump operably connectable to said outlet of said low gravity fed water system for receiving water from said housing and discharging water from said plurality of jets.

20. The low gravity fed water system of claim 19 wherein said tub and said housing being configured so that water entering said low gravity fed water system has a water head height of about 5 to about 10 inches, and a flow rate of water though said housing is greater than 100 gallons per minute.

21. The low gravity fed water system of claim 19 further comprising a grill covering at least one of said at least one inlet.

22. A method for circulating water in a spa or pool comprising a tub having a bathing chamber, the method comprising:

receiving water from the spa or pool along an upper inside surface of the tub in a housing having an inlet disposed below the waterline;

pumping water, received from at least one outlet in the housing disposed below the inlet to a plurality of jets for discharge back into the bathing chamber in the tub;

receiving air, via a vent opening in the housing disposed below the inlet, in the event of a blockage of the inlet causing air to be drawn into the housing via an upwardly-extending conduit inhibiting a suction being drawn on the inlet, the vent opening connected to the upwardly-extending conduit at a first end and having a second end disposed away from an inside surface of the tub and away from an inside of the housing above the waterline in ambient air; and filtering a first flow of water passing through the housing, and permitting a second flow of unfiltered water to pass through the housing.

23. The method of claim 22 wherein the tub has no completely submersed openings in the bathing chamber of the spa or pool for receiving water during operation of pumping water to the plurality of jets in the bathing chamber.

24. The method of claim 23 further comprising-inhibiting the likelihood of water in the housing creating the vortex.

25. The method of claim 24 wherein the receiving water comprises receiving the water entering the inlet having a water head height of about 5 to about 10 inches, and a flow rate of water greater than 100 gallons per minute.

26. The method of claim 22 further comprising inhibiting a likelihood of water in the housing creating a vortex.

27. The method of claim 22 wherein the receiving water comprises receiving the water entering the inlet having a water head height of about 5 to about 10 inches, and a flow rate of water greater than 100 gallons per minute.

28. A method for circulating water in a spa or pool comprising a tub, the method comprising:

receiving water from the spa or pool along an upper inside surface of the tub in a housing having an inlet disposed below the waterline;

passing the water in the housing to at least one outlet disposed below the inlet as a first flow of the water and a second flow of the water, and wherein at least a portion of the second flow being generally separate from the first flow of water; and pumping the water received from at least one outlet in the housing to a plurality of jets for discharge back into the tub; and filtering in the housing the first flow of water.

29. The method of claim 28 wherein the tub has no completely submersed openings in the bathing chamber of the spa or pool for receiving water during operation of pumping water to the plurality of jets in the bathing chamber.

30. The method of claim 29 further comprising inhibiting a likelihood of water in the housing creating a vortex.

31. The method of claim 28 wherein the entire second flow of water in the housing is separate from the first flow of water in the housing.

32. The method of claim 28 further comprising inhibiting a likelihood of water in the housing creating a vortex.

33. The method of claim 28 wherein the receiving water comprises receiving the water entering the inlet having a water head height of about 5 to about 10 inches, and a flow rate of water greater than 100 gallons per minute.

34. The method of claim 28 further comprising inhibiting the likelihood of water in the housing creating the vortex, and wherein the receiving water comprises receiving the water entering the inlet having a water head height of about 5 to about 10 inches, and a flow rate of water greater than 100 gallons per minute.

35. A low gravity fed water system for use in a spa or pool comprising a tub having a plurality of jets disposed in the tub for discharging water into a bathing chamber of the tub, said low gravity fed water system comprising;

a housing;

said housing having at least one inlet disposed below a waterline for receiving water from the spa or pool;

said housing having at least one outlet disposed below said at least one inlet, said at least one outlet operably connectable in fluid communication to a pump and to the plurality of jets;

said housing having at least one vent opening disposed in said housing below said at least one inlet;

an upwardly-extending conduct connectable at a first end to said vent opening, and having a second end above the waterline in ambient air and disposable away from an inside surface of said housing and away from an inside surface of the tub;

wherein in an event of a blockage of said at least one inlet, air is drawn into said housing via said upwardly-extending conduit inhibiting a suction being drawn on said at least one inlet; and a filter mount disposable in said housing and operably connectable to a filter device for receiving filtered water in said housing, and comprising a plurality of openings for receiving unfiltered water in said housing.

36. The low gravity fed water system of claim 35 further comprising a check valve disposed in said filter mount having a first position operable for allowing filtered water to pass through said housing and inhibit passage of unfiltered water through said housing, and a second position operable for allowing filtered water to pass through said housing and unfiltered water to pass through said housing.

37. A low gravity fed water system for use in a spa or pool comprising a tub having a plurality of jets disposed in the tub for discharging water into a bathing chamber of the tub, said low gravity fed water system comprising;

a housing;

said housing having at least one inlet disposed below a waterline for receiving water from the spa or pool;

said housing having at least one outlet disposed below said at least one inlet, said at least one outlet operably connectable in fluid communication to a pump and to the plurality of jets;

wherein a flow of water through said housing comprises a first flow and a second flow, and wherein at least a portion of the second flow of water from said at least one inlet to said outlet being entirely separate from the first flow of water from said at least one inlet to said outlet.

38. A low gravity fed water system for use in a spa or pool comprising a tub having a plurality of jets disposed in the tub for discharging water into a bathing chamber of the tub, said low gravity fed water system comprising;

a housing;

said housing having at least one inlet disposed below a waterline for receiving water from the spa or pool;

said housing having at least one outlet disposed below said at least one inlet, said at least one outlet operably connectable in fluid communication to a pump and to the plurality of jets;

wherein a flow of water through said housing comprises a first flow and a second flow, and wherein at least a portion of the second flow of water from said at least one inlet to said outlet being generally separate from the first flow of water from said at least one inlet to said outlet; and a filter assembly disposable in said housing, said filter assembly comprising a filter housing for containing a filter, wherein the first flow of water in said housing being through said filter housing and the second flow of water being around said filter housing, and wherein said filter assembly being removable from said housing with said filter therein.

39. A low gravity fed water system for use in a spa or pool comprising a tub having a plurality of jets disposed in the tub for discharging water into a bathing chamber of the tub, said low gravity fed water system comprising;

a housing;

said housing having at least one inlet disposed below a waterline for receiving water from the spa or pool;

said housing having at least one outlet disposed below said at least one inlet, said at least one outlet operably connectable in fluid communication to a pump and to the plurality of jets;

wherein a flow of water through said housing comprises a first flow and a second flow, and wherein at least a portion of the second flow of water from said at least one inlet to said outlet being generally separate from the first flow of water from said at least one inlet to said outlet; and a filter mount disposable in said housing and operably connectable to a filter device for receiving the first flow of water being filtered water, and comprising a plurality of openings for receiving the second flow of water being unfiltered water.

40. A method for circulating water in a spa or pool comprising a tub, the method comprising:

receiving water from the spa or pool along an upper inside surface of the tub in a housing having an inlet disposed below the waterline;

passing the water in the housing to at least one outlet disposed below the inlet as a first flow of the water and a second flow of the water, and wherein at least a portion of the second flow being entirely separate from the first flow of water; and pumping the water received from at least one outlet in the housing to a plurality of jets for discharge back into the tub.

* * * * *